US007835665B2

(12) United States Patent
Okabe et al.

(10) Patent No.: US 7,835,665 B2
(45) Date of Patent: Nov. 16, 2010

(54) PHOTOSENSITIVE UNIT AND IMAGE FORMING APPARATUS

(75) Inventors: Yasushi Okabe, Nagoya (JP); Naoya Kamimura, Nagoya (JP); Makoto Ishii, Nagoya (JP); Masatoshi Shiraki, Nisshin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 377 days.

(21) Appl. No.: 11/755,455

(22) Filed: May 30, 2007

(65) Prior Publication Data

US 2007/0280730 A1 Dec. 6, 2007

(30) Foreign Application Priority Data

May 30, 2006 (JP) ..... 2006-150670

(51) Int. Cl.
*G03G 21/18* (2006.01)
*G03G 15/04* (2006.01)

(52) U.S. Cl. ..... 399/113; 399/119

(58) Field of Classification Search ..... 399/107, 399/110, 111, 113, 119, 120
See application file for complete search history.

(56) References Cited

U.S. PATENT DOCUMENTS 4,839,691 A 6/1989 Tagawa et al.
2006/0093399 A1* 5/2006 Okabe et al. ..... 399/111
2007/0009282 A1* 1/2007 Sato et al. ..... 399/90
2007/0230998 A1* 10/2007 Ishii ..... 399/111

FOREIGN PATENT DOCUMENTS

| | | |
|---|---|---|
| JP | 62209467 | 9/1987 |
| JP | 62209572 | 9/1987 |
| JP | 62229257 | 10/1987 |
| JP | 8101623 | 4/1996 |
| JP | 2001027847 | 1/2001 |

* cited by examiner

*Primary Examiner*—David M Gray
*Assistant Examiner*—Rodney Bonnette
(74) *Attorney, Agent, or Firm*—Banner & Witcoff, Ltd

(57) ABSTRACT

A photosensitive unit is described. The photosensitive unit may include a developer cartridge including a developing agent carrier and a casing, a photosensitive member, and a side wall. The casing is provided with a pivoting member including a pressuring portion applied with an external pressing force and a fitting projection fitted to the side wall. The pivoting member is configured to be pivoted along a pressing direction for pressing the developing agent carrier toward the photosensitive member when a pressing force is applied to the pressuring portion, or along a pressure releasing direction opposite to the pressing direction. The side wall is formed with a fit portion to which the fitting projection is loosely fitted so that a movement of the fitting projection along a pivoting direction of the pivoting member is allowed.

27 Claims, 26 Drawing Sheets

27

27

PHOTOSENSITIVE UNIT AND IMAGE FORMING APPARATUS

CROSS REFERENCE TO RELATED APPLICATION

This application claims priority based on Japanese Patent Application No. 2006-150670, filed on May 30, 2006, the disclosure of which is herein incorporated by reference.

TECHNICAL FIELD

Aspects of the present invention relate to an image forming apparatus such as a laser printer and a photosensitive unit equipped in the image forming apparatus.

BACKGROUND

Conventionally, in a known image forming apparatus such as a laser printer, a developer cartridge including a developing roller for supplying a toner to a photosensitive drum is detachably attachable to an image forming apparatus body which includes a photosensitive drum to be formed with an electrostatic latent image.

To prevent the developer cartridge from dropping off from the image forming apparatus body or to position the developer cartridge with respect to the photosensitive drum, a various types of units have been proposed to fix (lock) the developer cartridge at a determined position on the side of the image forming apparatus body.

For example, some developing unit is proposed to which a grip having a hook is pivotably provided. When this developing unit is disposed in a space of the electrophotographic copier body and the grip is pivoted, the hook engages with a pin in the space and the developing unit is fixed in the space.

Some copier is proposed to which a developing unit is provided with a grip member in a standable and foldable manner is detachably attachable. The arm of this grip member is integrally provided with a hook. This hook and a lock pin provided on the main body frame of the copier body configure an engaging unit which locks or unlocks the developing unit with respect to the copier.

Some electronic copier is proposed to which a developing unit provided with a handle which inclines and pivots is detachably attachable. When the protective cover of the electronic copier is opened and the developing unit is inserted in the accommodation space in the electronic copier, the hook portion integrally molded with a rotation shaft end on the handle is positioned corresponding to a support pin protruding in the accommodation space. When the developing unit is positioned in a completely attached state in the accommodation space, the handle is allowed to incline and pivot and the hook is engaged with the support pin to maintain the locking state, it becomes impossible to release the hook portion and it becomes possible to close the protective cover. On the other hand, when the developing unit is not in a regular attached state, the hook portion strikes the support pin and the handle cannot incline and pivot, and the hook portion and the support pin are in an unlocked state to stand the handle, thereby the protective cover cannot be closed.

Some developing unit detachably attachable to an image forming apparatus is proposed. The developing unit includes a grip for transportation, a second engaging portion provided on the grip and formed with a hook which engages with a first engaging portion on the side of the image forming apparatus and locks the developing unit so that it cannot be drawn out, and a coil spring which urges a second engaging portion so that the first engaging portion and the hook are engaged with each other. The drawing of the developing unit out from the image forming apparatus requires to hold the grip, move and retreat the second engaging portion from the engaged state of the first engaging portion with the hook against the urging force of the coil spring, in a direction which allows the developing unit to be drawn out from the image forming apparatus.

Some printer is proposed in which a processing unit including a photosensitive drum, a charger, a developing unit and the like as a unit is fixed by a lock unit and attached to the printer. The processing unit is provided with a grip to take out the unit and in the vicinity of the grip, and is provided with a lock releasing lever pivoting in a direction for releasing the lock unit and an urging unit for urging the lock releasing lever in a direction opposite to the direction for releasing the lock unit. When detaching the processing unit, the grip and the lock releasing lever are held together to pivot the lock releasing lever in the direction for releasing the lock unit, thereby releasing the lock unit.

In a known image forming apparatus, a developing roller is brought to press against a photosensitive drum at the printing operation in order to secure a reliable toner supply from the developing roller to the photosensitive drum.

In the lock unit described above, the developer cartridge can be reliably locked at a fixed position on the side of the image forming apparatus body. However, the developer cartridge locked to the fixed position is not allowed to move. Accordingly, the developing roller may fail to secure pressing operation with respect to the photosensitive drum, or a complicated mechanism is required in order to secure the pressing operation.

SUMMARY

One aspect of the present invention may provide a photosensitive unit which can achieve a pressing operation of the developing agent carrier to the photosensitive member and reliably lock a developer cartridge with a simple structure, and an image forming apparatus equipped with the photosensitive unit.

The same or different aspect of the present invention may provide a photosensitive unit including: a developer cartridge including a developing agent carrier that carries a developing agent and a casing that supports the developing agent carrier and accommodates the developing agent; a photosensitive member disposed so that the developing agent carrier is press-contacted to the photosensitive member, and in which an electrostatic latent image is developed by the developing agent supplied from the developing agent carrier; and a side wall to which the developer cartridge is detachably attached, wherein the casing is provided with a pivoting member including a pressuring portion applied with an external pressing force and a fitting projection fitted to the side wall, and the pivoting member is configured to be pivoted along a pressing direction for pressing the developing agent carrier toward the photosensitive member when a pressing force is applied to the pressuring portion, or along a pressure releasing direction opposite to the pressing direction, and the side wall is formed with a fit portion to which the fitting projection is loosely fitted so that a movement of the fitting projection along a pivoting direction of the pivoting member is allowed.

One or more aspects of the present invention provide an image forming apparatus including a photosensitive unit, and an image forming apparatus body which the photosensitive unit is configured to be detached from and attached to in a slidable manner, wherein the photosensitive unit includes: a plurality of developer cartridges including a developing agent carrier that carries a developing agent and a casing that supports the developing agent carrier and accommodates the developing agent; a plurality of photosensitive members disposed so that the developing agent carrier is press-contacted to the photosensitive member, and in which an electrostatic latent image is developed by the developing agent supplied from the developing agent carrier; and a plurality of side walls to which the developer cartridge is detachably attached, wherein the respective casing is provided with a pivoting member including a pressuring portion applied with an external pressing force and a fitting projection fitted to the side wall, and the pivoting member is configured to be pivoted along a pressing direction for pressing the developing agent carrier toward the photosensitive member when a pressing force is applied to the pressuring portion, or along a pressure releasing direction opposite to the pressing direction, and the respective side wall is formed with a fit portion to which the fitting projection is loosely fitted so that a movement of the fitting projection along a pivoting direction of the pivoting member is allowed, and the image forming apparatus body includes a pressing force generating unit applying a pressing force to the pressuring portion.

DETAILED DESCRIPTION

First Embodiment

1. Overall Configuration of Color Laser Printer

Figure 1:
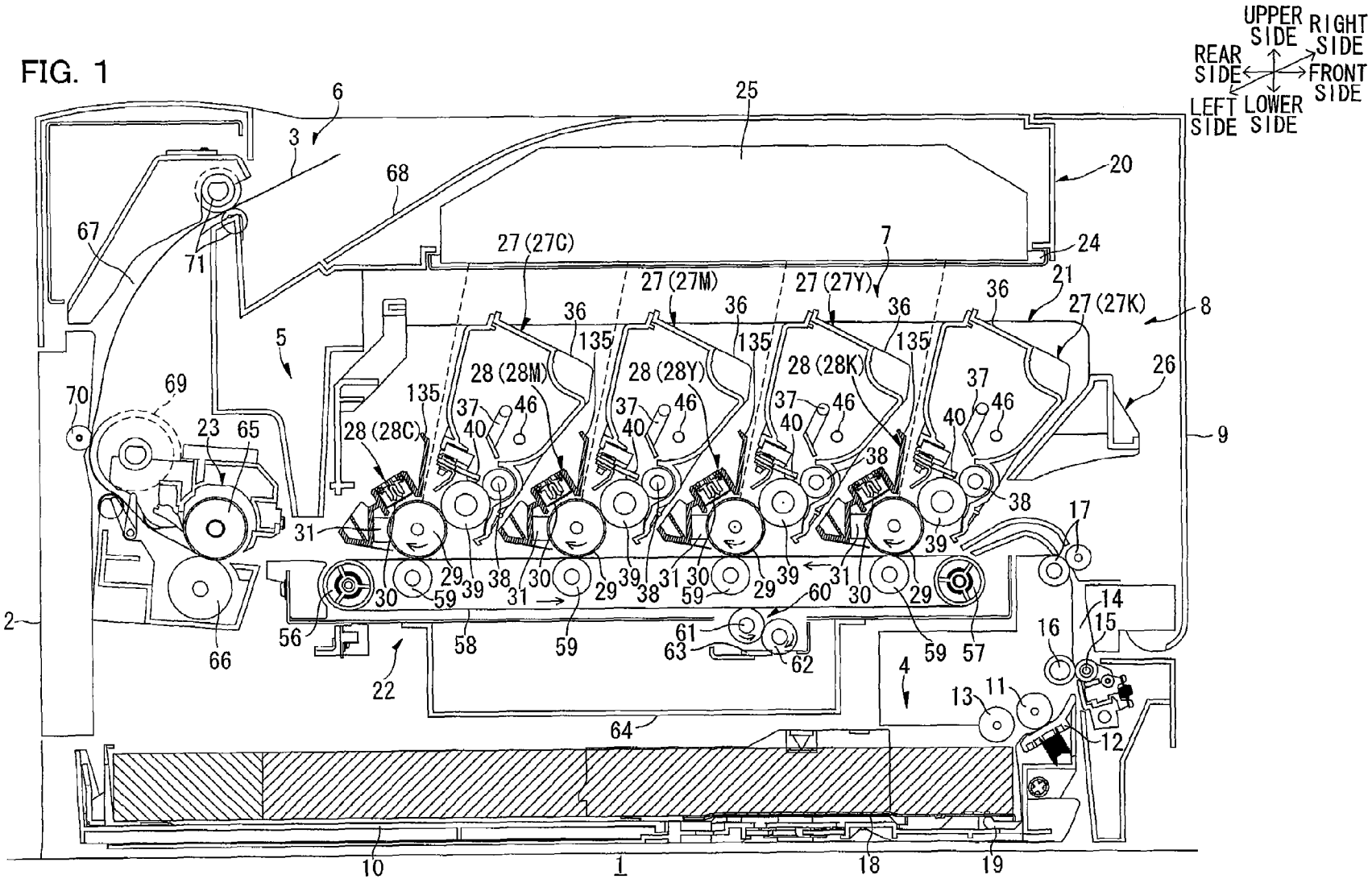
FIG. 1 is a sectional side view showing an illustrative aspect of a color laser printer as an example of an image forming apparatus of one or more aspects of the present invention.

FIG. 1 is a sectional side view showing an illustrative aspects of a color laser printer as an example of an image forming apparatus of one or more aspects of the present invention.

This color laser printer 1 is a horizontal tandem type color laser printer in which a plurality of later described drum subunits 28 are disposed in parallel in the horizontal direction, and includes, in a main body casing 2 as an example of an image forming apparatus body, a sheet feeding section 4 for feeding a sheet 3, an image forming section 5 for forming an image on the fed sheet 3 and a sheet ejecting section 6 for ejecting the sheet 3 formed with an image.

(1) Main Body Casing

The main body casing 2 is formed in a generally rectangular box shape as viewed from the side, and formed therein with a drum receiving space 7 for receiving a drum unit 26 as an example of a photosensitive unit described later.

One side surface of the main body casing 2 is formed with a mounting port 8 which communicates with a drum receiving space 7. The side surface formed with the mounting port 8 is provided with a front cover 9 for opening and closing the mounting port 8. This front cover 9 is inclined to the side of the main body casing 2 to open the mounting port 8 and stands along the one side surface of the main body casing 2 to close the mounting port 8. Via the mounting port 8 which is in an opened state, the drum unit 26 can be attached and detached to and from the drum receiving space 7.

In the following description, the side on which the front cover 9 is provided (right side in FIG. 1) is referred to as a "front side" and the opposite side of the front side (left side in FIG. 1) is referred to as a "rear side". The right and left sides are defined when this color laser printer 1 is viewed from the front side. That is, the near side of the sheet in FIG. 1 is referred to as a "left side" and the far side of the sheet is referred to as a "right side". In some cases, the left and right directions may be referred to as a "width (lateral) direction". Unless otherwise specified, as for the drum unit 26 and a developer cartridge 27, the left and right sides, the front and rear sides, and the upper and lower sides are defined when the drum unit 26 and the developer cartridge 27 are attached in the main body casing 2.

(2) Sheet Feeding Section

The sheet feeding section 4 is provided on the bottom portion of the main body casing 2, and includes a sheet feeding tray 10, a separation roller 11, a separation pad 12, a sheet feeding roller 13, a sheet dust removing roller 15, a pinch roller 16, and regist rollers 17.

The sheet feeding tray 10 includes a sheet pressing plate 18 inside thereof and a lever 19 on the front end portion thereof. The lever 19 lifts the front end portion of the sheet pressing plate 18.

The sheets 3 placed on the sheet pressing plate 18 are transported to a separation position between the separation roller 11 and the separation pad 12 by the rotation of the sheet feeding roller 13 and separated one by one at the separation position, and then each sheet 3 passes a space between the sheet dust removing roller 15 and the pinch roller 16, has the sheet dust removed, and is transported toward the resist rollers 17.

The resist rollers 17 resister the sheet 3 and then transport it to a transport belt 58.

(3) Image Forming Section

The image forming section 5 includes a scanning section 20, a processing section 21, a transferring section 22, and a fixing section 23.

(3-1) Scanning Section

The scanning section 20 is disposed on the upper portion of the main body casing 2. This scanning section 20 includes a scanning unit 25 and a scanner casing 24 extending in the front, back, left and right directions to support and accommodate a scanning unit 25 on the upper portion thereof. The scanning unit 25 has, for example, optical elements such as four light sources, a polygonal mirror, an fθ lens, a reflection mirror, and a face tangle error correction lens. The light source emits laser beams based on image data. Thereafter, the laser beam is deflected and scanned by the polygonal mirror, passes through the fθ lens and the face tangle error correction lens, reflected by the reflecting mirror, and then irradiated by high speed scanning on the surface of a photosensitive drum 29 for each color as an example of the later described photosensitive member.

(3-2) Processing Section

The processing section 21 is disposed below the scanning section 20 and above the sheet feeding section 4, and includes the single drum unit 26 and four developer cartridges 27 corresponding to respective colors.

(3-2-1) Drum Unit

The drum unit 26 includes four drum subunits 28 corresponding to respective colors, that is, the drum subunits 28 include a black drum subunit 28K, a yellow drum subunit 28Y, a magenta drum subunit 28M, and a cyan drum subunit 28C.

The drum subunits 28 are disposed in a spaced parallel relation in the anteroposterior direction with each other. More specifically, the black drum subunit 28K, the yellow drum subunit 28Y, the magenta drum subunit 28M and the cyan drum subunit 28C are disposed in this order from the front side to the rear side.

As described later, each drum subunit 28 includes a pair of side frames 134 as an example of a side wall and a center frame 135 extending therebetween (see FIG. 12).

Figure 2:
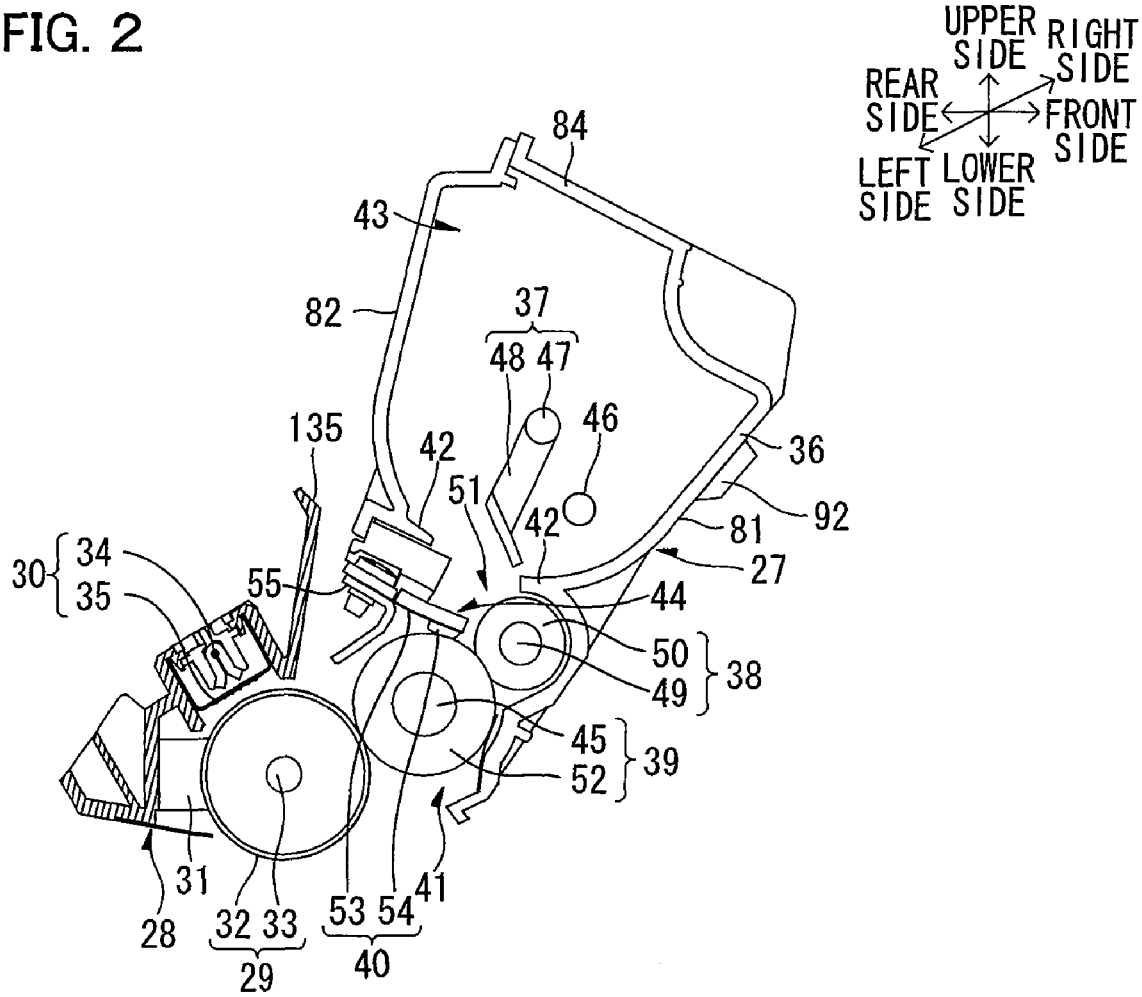
FIG. 2 is a sectional side view of a developer cartridge and a drum subunit.

FIG. 2 is a sectional side view of the developer cartridge and the drum subunit. A grip 103 described later is omitted in FIGS. 1 and 2.

Each drum subunit 28 includes the photosensitive drum 29, a scorotron charger 30 and a cleaning brush 31, as shown in FIG. 2.

The photosensitive drum 29 includes a drum body 32 disposed along the left and right direction, formed in a cylindrical shape and having the outermost surface layer formed of a positively chargeable photosensitive layer of polycarbonate, and a drum shaft 33 disposed along the axial direction of the drum body 32. The drum body 32 is rotatably provided with respect to the drum shaft 33. The both axial end portions of the drum shaft 33 are respectively inserted through the pair of side frames 134 (see FIG. 19) and unrotatably supported on later described side plates 133 (refer to FIG. 19). The photosensitive drum 29 is rotated by a driving force from a motor (not shown) provided in the main body casing at the time of image formation.

The scorotron charger 30 is disposed in an opposed spaced relation to the photosensitive drum 29 at the position obliquely rearwardly above the photosensitive drum 29, and supported by the center frame 135. This scorotron charger 30 includes a discharge wire 34 which is disposed in an opposed spaced relation to the photosensitive drum 29, and a grid 35 provided between the discharge wire 34 and the photosensitive drum 29. At the time of image formation, the discharge wire 34 is applied with a high voltage, which allows the discharge wire 34 to generate corona discharge, and at the same time a voltage is applied to the grid 35, which controls the amount of charge supplied to the photosensitive drum 29. As a result, the surface of the photosensitive drum 29 is positively and uniformly charged.

The cleaning brush 31 is disposed in back of the photosensitive drum 29 so as to contact the photosensitive drum 29 in an opposed manner, and supported on the center frame 135. The cleaning brush 31 is applied with a cleaning bias at the time of image formation.

(3-2-2) Developer Cartridge

The developer cartridges 27 are provided respectively so as to be detachably attached to the drum subunits 28 corresponding to the respective colors, as shown in FIG. 1. That is, the developer cartridges 27 include a black developer cartridge 27K which is detachably attached to the black drum subunit 28K, a yellow developer cartridge 27Y detachably attached to the yellow drum subunit 28Y, a magenta developer cartridge 27M detachably attached to the magenta drum subunit 28M, and a cyan developer cartridge 27C detachably attached to the cyan drum subunit 28C.

Each developer cartridge 27 includes a developer frame 36 as an example of a casing, and also includes an agitator 37, a feed roller 38, a developing roller 39 as an example of a developing agent carrier, and a layer-thickness regulating blade 40 all of which are provided in the developer frame 36, as shown in FIG. 2.

The developer frame 36 is formed in a box shape with the lower end portion thereof formed with an opening 41 and partitioned into a toner accommodation chamber 43 and a developing chamber 44 by a partition wall 42. The partition wall 42 is formed with a communication port 51 which communicates the toner accommodation chamber 43 and the developing chamber 44 with each other.

The toner accommodation chamber 43 accommodates a toner corresponding to each color.

The toner, as an example of a developing agent, which corresponds to each color uses a positively chargeable non-magnetic single-component polymer toner which is mixed with a colorant of yellow, magenta, cyan, or black corresponding to the color of the toner.

The toner accommodation chamber 43 is provided with detection windows 46 for detecting the residual quantity of the toner accommodated in the toner accommodation chamber 43. The detection windows 46 are embedded on both side walls 83 of the developer frame 36 (see FIGS. 8 and 9) and are disposed in an opposed relation with each other with the toner accommodation chamber 37 sandwiched therebetween.

The agitator 37 is provided in the toner accommodation chamber 43, and includes an agitator rotating shaft 47 rotatably supported on the both side walls 83 of the developer frame 36, and an agitating member 48 provided across the axial direction of the agitator rotating shaft 47 and extending radially outward from the agitator rotating shaft 47. The agitator rotating shaft 47 is transmitted with a driving force from a motor (not shown) provided in the main body casing 2 and the agitating member 48 moves circumferentially in the toner accommodation chamber 43 at the time of image formation.

The feed roller 38 is provided below the communication port 51 in the developing chamber 44. This feed roller 38 includes a metallic feed roller shaft 49 rotatably supported on the both side walls 83 of the developer frame 36, and a sponge roller 50 formed of an electrically conductive sponge and covering the feed roller shaft 49. This feed roller 38 is transmitted with a driving force from a motor (not shown) provided in the main body casing 2 and is rotated at the time of image formation.

The developing roller 39 is provided at the position obliquely downwardly rearward with respect to the feed roller 38 in the developing chamber 44. This developing roller 39 includes a metallic developing roller shaft 45 rotatably supported on the both side walls 83 of the developer frame 36, and a rubber roller 52 formed of an electrically conductive rubber and covering the developing roller shaft 45.

The rubber roller 52 has two layers. One layer is a rubber roller layer formed of an electrically conductive urethane rubber a silicone rubber, an EPDM rubber and the like containing fine carbon particles. The other layer is a coating layer for coating the surface of the rubber roller layer and having a urethane rubber, a urethane resin, a polyimide resin and the like as a major component.

The developing roller 39 is disposed with respect to the feed roller 38 so that the rubber roller 52 and the sponge roller 50 are in press contact with each other. The developing roller 39 is disposed so as to be exposed downward from the opening 41 of the developing chamber 44.

The developing roller 39 is transmitted with a driving force from a motor (not shown) provided in the main body casing 2 and is rotated at the time of image formation. In addition, the developing roller 39 is applied with a developing bias.

The layer-thickness regulating blade 40 is provided so as to press contact with the developing roller 39 from above in the developing chamber 44. The layer-thickness regulating blade 40 includes a blade 53 formed of a metallic leaf spring material, and a pressing member 54 which is in a generally semicircular shape as seen in section, formed of an electrically insulative silicone rubber and provided on the distal end of the blade 53.

The proximal edge of the blade 53 is fixed on the partition wall 42 by a fixing member 55. The elastic force of the blade 53 brings the pressing member 54 provided on the distal end of the blade 53 in press contact with the rubber roller 52 of the developing roller 39 from above.

(3-2-3) Developing Operation in Processing Section

In each developer cartridge 27, the toner corresponding to each color accommodated in the toner accommodation chamber 43 moves toward the communication port 51 by its own weight and is released from the communication port 51 to the developing chamber 44 while being agitated by the agitator 37.

The toner released from the communication port 51 to the developing chamber 44 is fed to the feed roller 38. The toner fed to the feed roller 38 is then fed to the developing roller 39 by the rotation of the feed roller 38. At this time, the toner is triboelectrically positively charged between the feed roller 38 and the developing roller 39 applied with the developing bias.

The toner fed to the developing roller 39 enters between the pressing member 54 of the layer-thickness regulating blade 40 and the rubber roller 52 of the developing roller 39 along with the rotation of the developing roller 39, and is carried on the surface of the rubber roller 52 as a thin layer having a constant thickness.

On the other hand, in the drum subunit 28 corresponding to each developer cartridge 27, the scorotron charger 30 generates corona discharge and positively and uniformly charges the surface of the photosensitive drum 29.

The surface of the photosensitive drum 29 is positively and uniformly charged by the scorotron charger 30 along with the rotation of the photosensitive drum 29, and then, as shown in FIG. 1, exposed to light by the high speed scanning of the laser beam emitted from the scanning section 20 (see a dotted line in the drawing). As a result, an electrostatic latent image corresponding to the image to be formed on the sheet 3 is formed on the surface of the photosensitive drum 29.

With the further rotation of the photosensitive drum 29, the toner carried on the surface of the developing roller 39 and positively charged is then fed to the electrostatic latent image formed on the surface of the photosensitive drum 29, that is, a portion exposed to light by laser beam and having lower potential on the surface of the uniformly and positively charged photosensitive drum 29, when the toner contacts the photosensitive drum 29 in an opposed manner by the rotation of the developing roller 39. Consequently, the electrostatic latent image on the photosensitive drum 29 is visualized by developing, and the toner image corresponding to each color is carried on the surface of the photosensitive drum 29 by reversal developing.

The toner remaining on the surface of the photosensitive drum 29 after the transfer is recovered by the developing roller 39. Additionally, the sheet powder from the sheet 3 which adheres on the surface of the photosensitive drum 29 after the transfer, is recovered by the cleaning brush 31.

(3-3) Transferring Section

The transferring section 22 is disposed above the sheet feeding section 4 and below the processing section 21 along the anteroposterior direction in the main body casing 2. This transferring section 22 includes a drive roller 56, a driven roller 57, the transport belt 58, the transfer rollers 59, and a cleaning section 60.

The drive roller 56 and the driven roller 57 are disposed in an opposed spaced relation to each other in the anteroposterior direction. Specifically, the drive roller 56 is disposed rearward of the cyan drum subunit 28C. The driven roller 57 is disposed forward of the black drum subunit 28K.

The transport belt 58 is an endless belt formed of a resin film such as conductive polycarbonate and polyimide in which conductive particles such as carbon are dispersed. This transport belt 58 is wound between the drive roller 56 and the driven roller 57.

The drive roller 56 is transmitted with a driving force from a motor (not shown) provided in the main body casing 2 and is rotated at the time of image formation. The transport belt 58 is then moved circumferentially in the opposite direction to the photosensitive drum 29 between the drive roller 56 and the driven roller 57 at a transfer position where the transport belt 58 contacts the photosensitive drum 29 of each drum subunit 28 in an opposed manner, and the driven roller 57 follows the movement of the transport belt 58.

The transfer roller 59 is provided so as to be opposed to the photosensitive drum 29 with the transport belt 58 sandwiched between itself and the photosensitive drum 29 within the ring of the transport belt 58 which is wound between the drive roller 56 and the driven roller 57. The transfer roller 59 includes a metallic roller shaft covered with a rubber roller formed of electrically conductive rubber. Moreover, the transfer roller 59 is provided so as to follow the circumferential movement of the transport belt 58 and rotates in the same direction as the circumferential direction of the transport belt 58 at a transfer position in which the transfer roller 59 contacts the transport belt 58 in an opposed manner. The transfer roller 59 is applied with a transfer bias from a high voltage board (not shown) provided in the main body casing 2 at the time of image formation.

The cleaning section 60 is disposed below the transport belt 58 which is wound between the drive roller 56 and the driven roller 57, and includes a primary cleaning roller 61, a secondary cleaning roller 62, a scraping blade 63, and a toner reservoir 64.

The primary cleaning roller 61 is disposed to contact the lower side of the transport belt 58 which is on the opposite side of the upper side of the transport belt 58 contacted by the photosensitive drum 29 and the transfer roller 59, and provided so as to follow the circumferential movement of the transport belt 58 and rotates in the same direction as the circumferential direction of the transport belt 58 at this contact position. The primary cleaning roller 61 is applied with a primary cleaning bias at the time of image formation.

The secondary cleaning roller 62 is provided so as to contact the primary cleaning roller 61 from below, and disposed so as to rotate in the direction opposite to the rotation direction of the primary cleaning roller 61 at this contact position. The secondary cleaning roller 62 is applied with a secondary cleaning bias at the time of image formation.

The scraping blade 63 is provided so as to contact the secondary cleaning roller 62 from below.

The toner reservoir 64 is provided below the primary cleaning roller 61 and the secondary cleaning roller 62 so as to reserve the toner dropping from the secondary cleaning roller 62.

The sheet 3 fed from the sheet feeding section 4 is transported by the transport belt 58 that is circumferentially moved by the drive of the drive roller 56 and the following movement of the driven roller 57 so as to sequentially pass the transfer positions corresponding to the respective drum subunits 28 from the front side toward the rear side. On the way through the transportation, the toner images of the respective color carried on the photosensitive drums 29 of the respective drum subunit 28 are sequentially transferred and thus forms color images on the sheet 3.

That is, for example, the black toner image carried on the surface of the photosensitive drum 29 of the black drum subunit 28K is transferred onto the sheet 3, and then, the yellow toner image carried on the surface of the photosensitive drum 29 of the yellow drum subunit 28Y is transferred and overlapped onto the sheet 3 which has already been transferred with the black toner image. Afterwards, the same operation is repeated, and the magenta toner image carried on the surface of the photosensitive drum 29 of the magenta drum subunit 28M and the cyan toner image carried on the surface of the photosensitive drum 29 of the cyan drum subunit 28C are transferred and overlapped onto the sheet 3 to form a color image on the sheet 3.

On the other hand, in the transferring operation described above, the toner that adheres to the surface of the transport belt 58 is transferred from the surface of the transport belt 58 to the primary cleaning roller 61 by the first cleaning bias, and then transferred to the secondary cleaning roller 62 by the second cleaning bias, in the cleaning section 60. Afterwards, the toner transferred to the secondary cleaning roller 62 is scraped away by the scraping blade 63, drops from the secondary cleaning roller 62, and reserved in the toner reservoir 64.

(3-4) Fixing Section

The fixing section 23 is disposed in back of the transferring section 22, and includes a heat roller 65 and a pressing roller 66 which apply pressure on the heat roller 65. The color image transferred to the sheet 3 is thermally fixed on the sheet 3 in the fixing section 23 by application of heat and pressure during the time when the sheet 3 passes between the heat roller 65 and the pressing roller 66.

(4) Sheet Ejecting Section

The sheet ejecting section 6 includes a sheet ejecting transport path 67, a transport roller 69, a pinch roller 70, a pair of sheet ejecting rollers 71 and a sheet ejection tray 68. The sheet 3 transported from the fixing section 23 is transported along the sheet ejecting transport path 67 by the transport roller 69 and the pinch roller 70, and then ejected on the sheet ejection tray 68 by the sheet ejecting rollers 71.

2. Developer Cartridge

Figure 3:
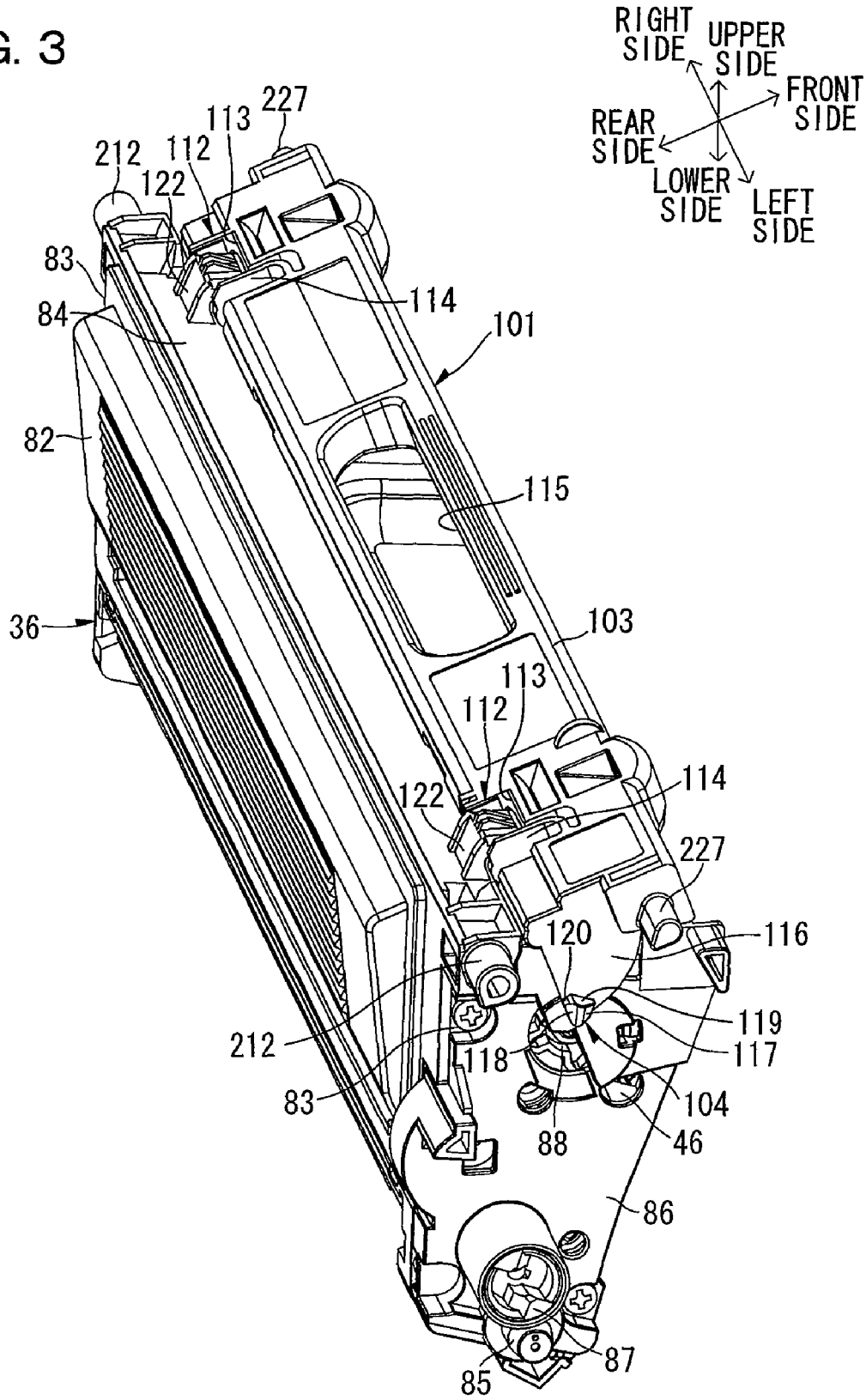
FIG. 3 is a perspective view of the developer cartridge.
Figure 4:
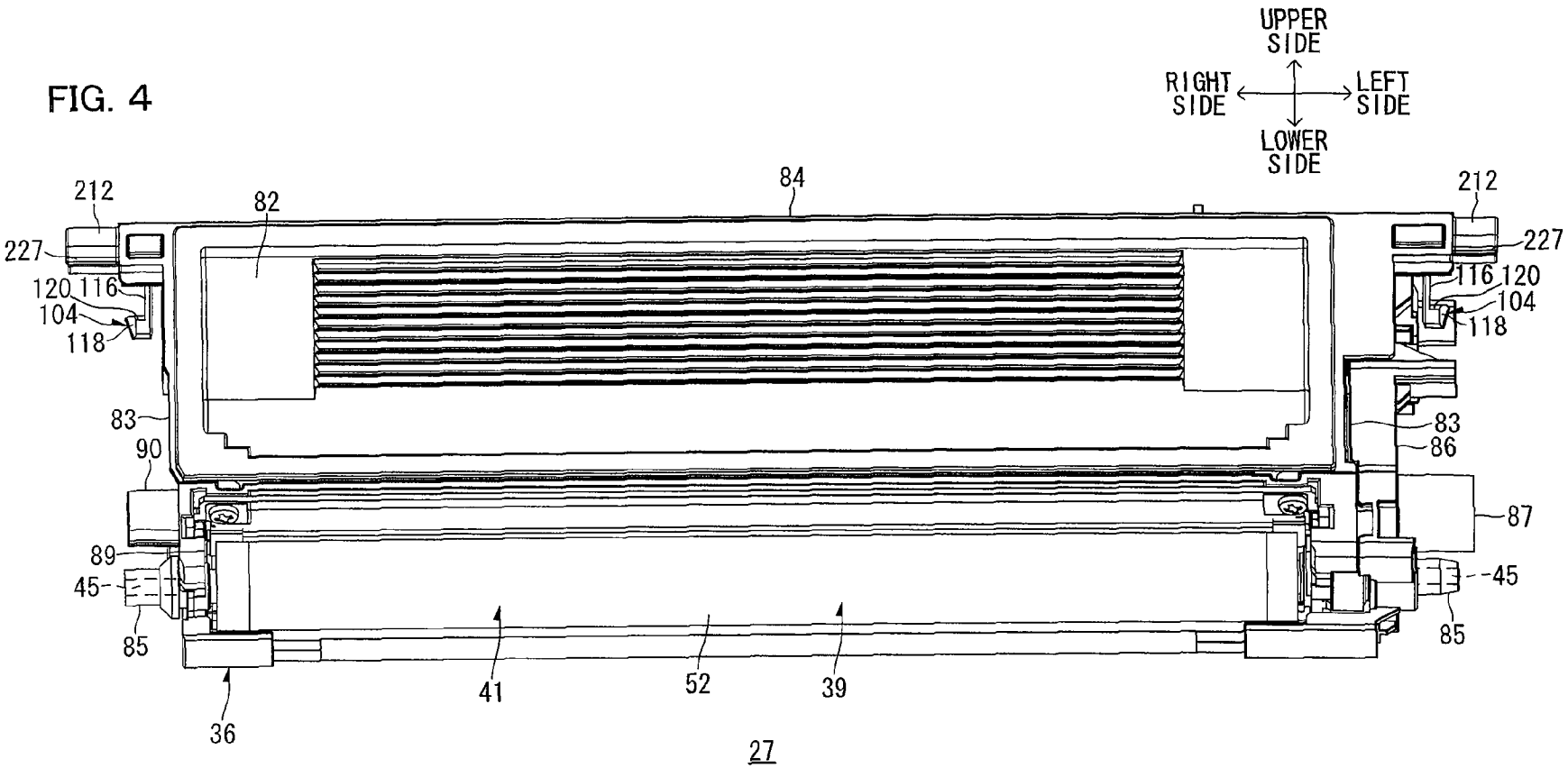
FIG. 4 is a rear view of the developer cartridge.
Figure 5:
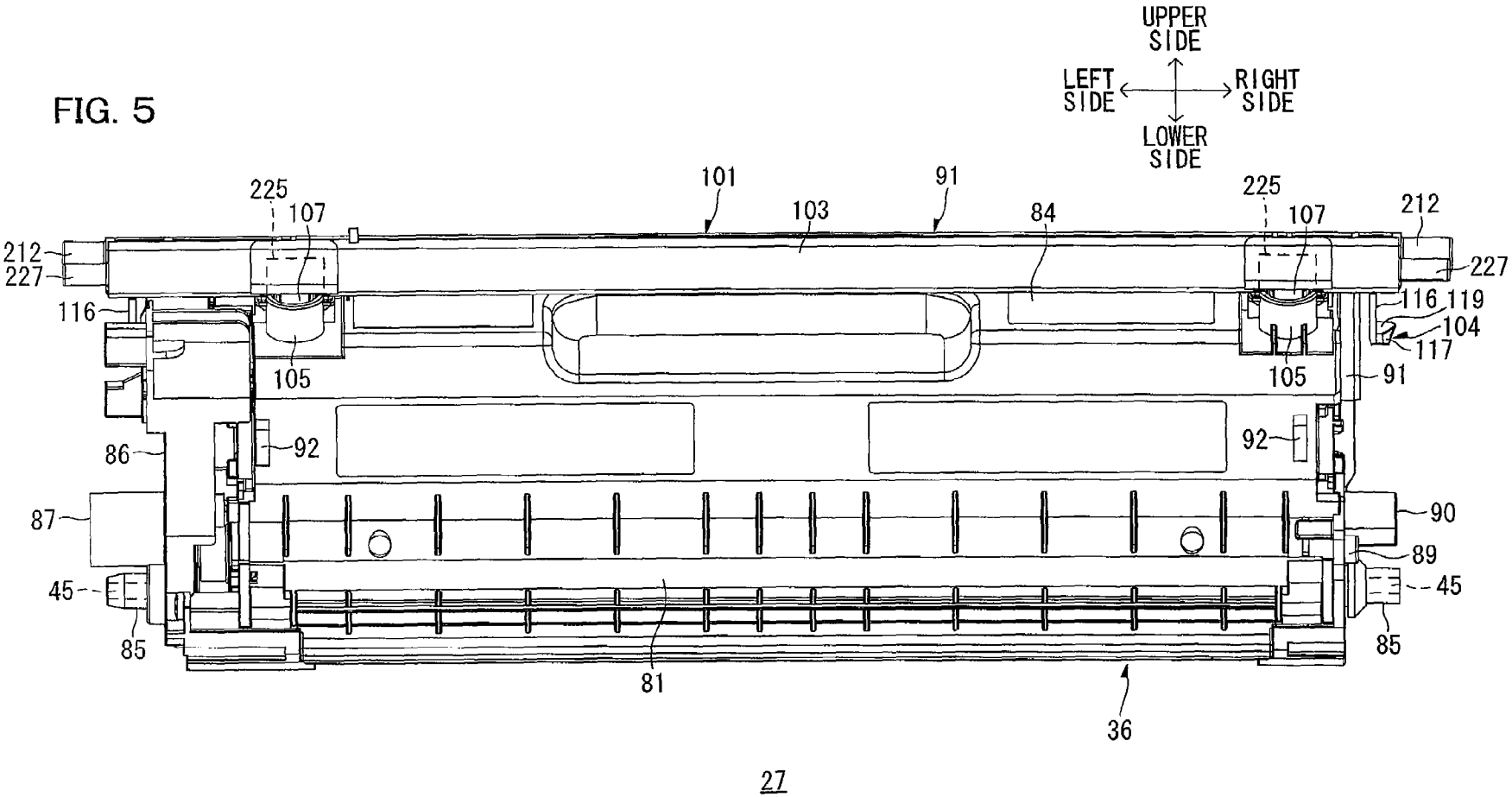
FIG. 5 is a front view of the developer cartridge.
Figure 6:
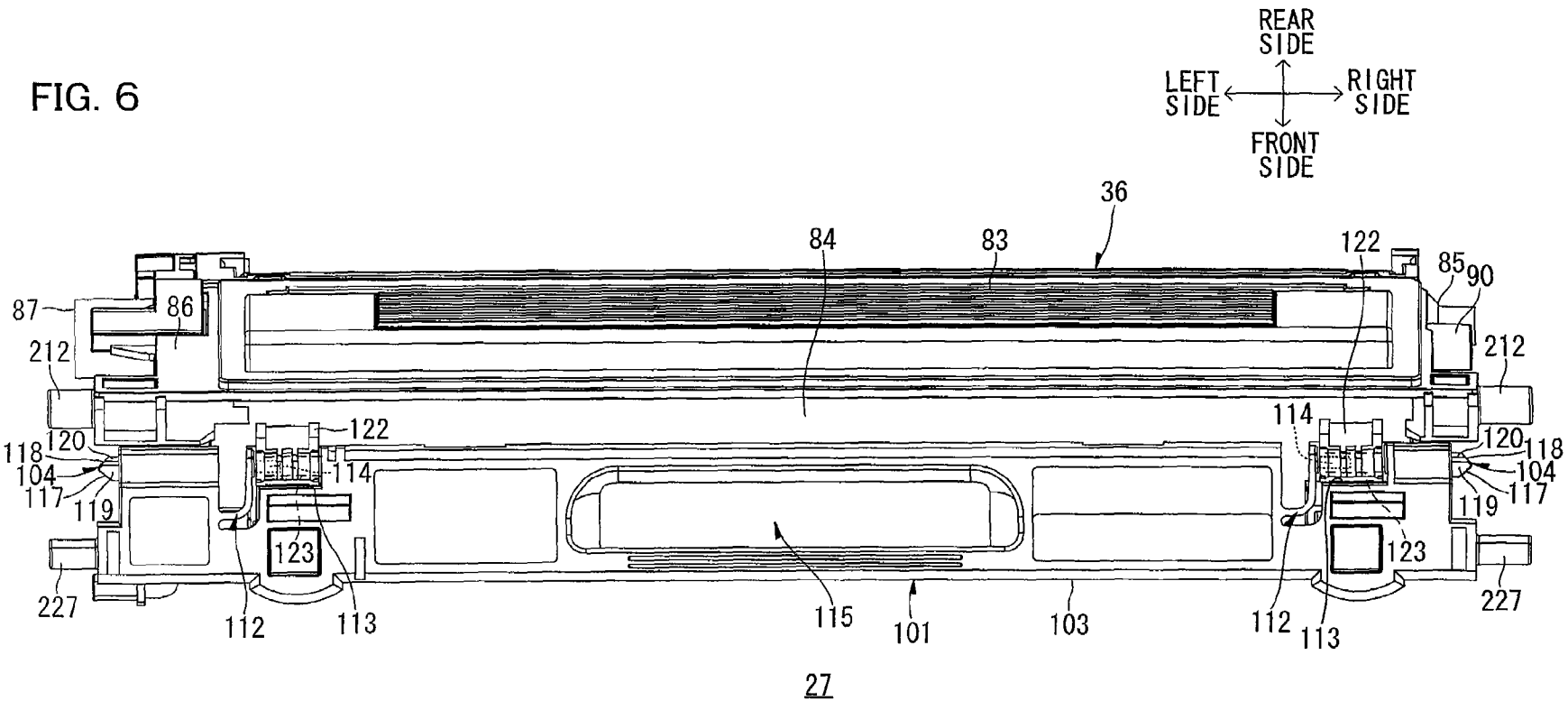
FIG. 6 is a plan view of the developer cartridge.
Figure 7:
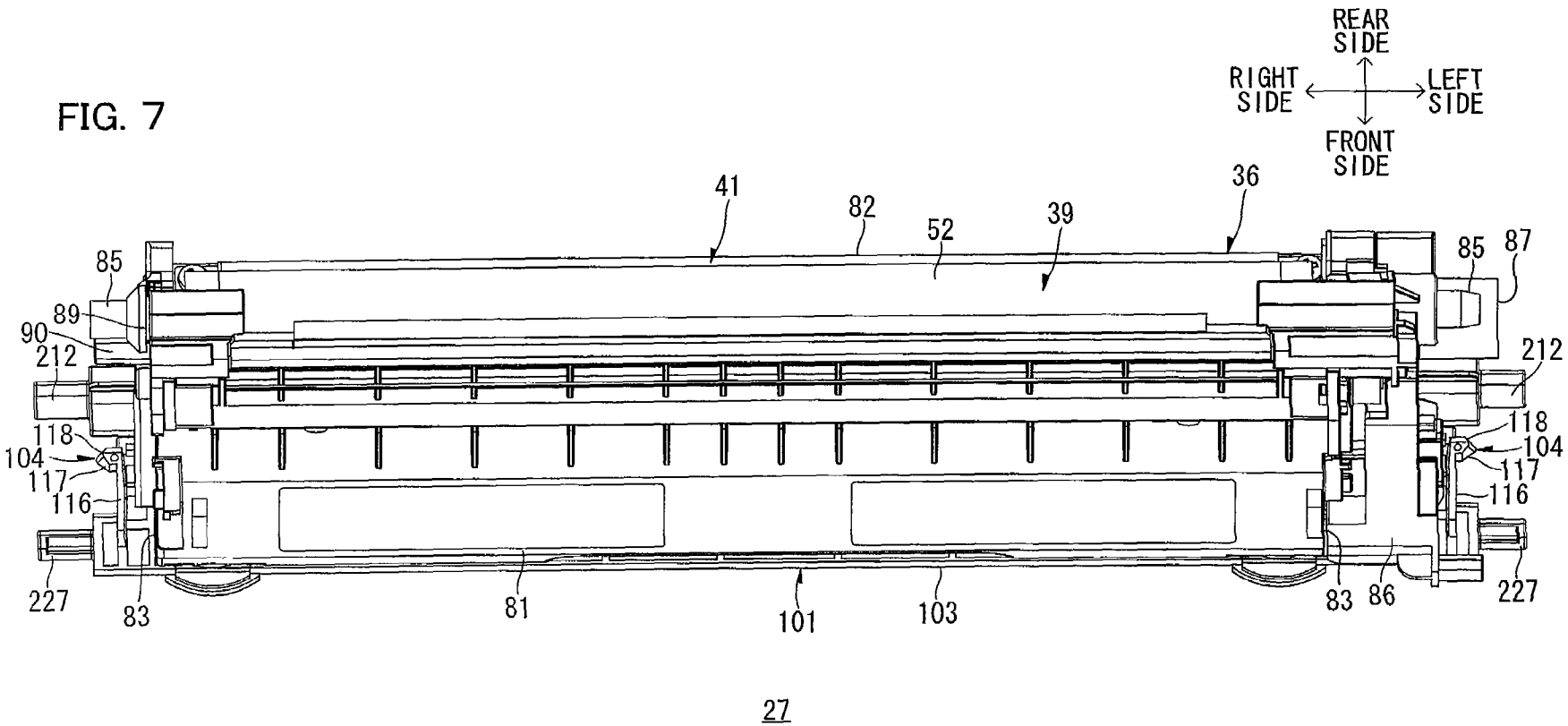
FIG. 7 is a bottom view of the developer cartridge.
Figure 8:
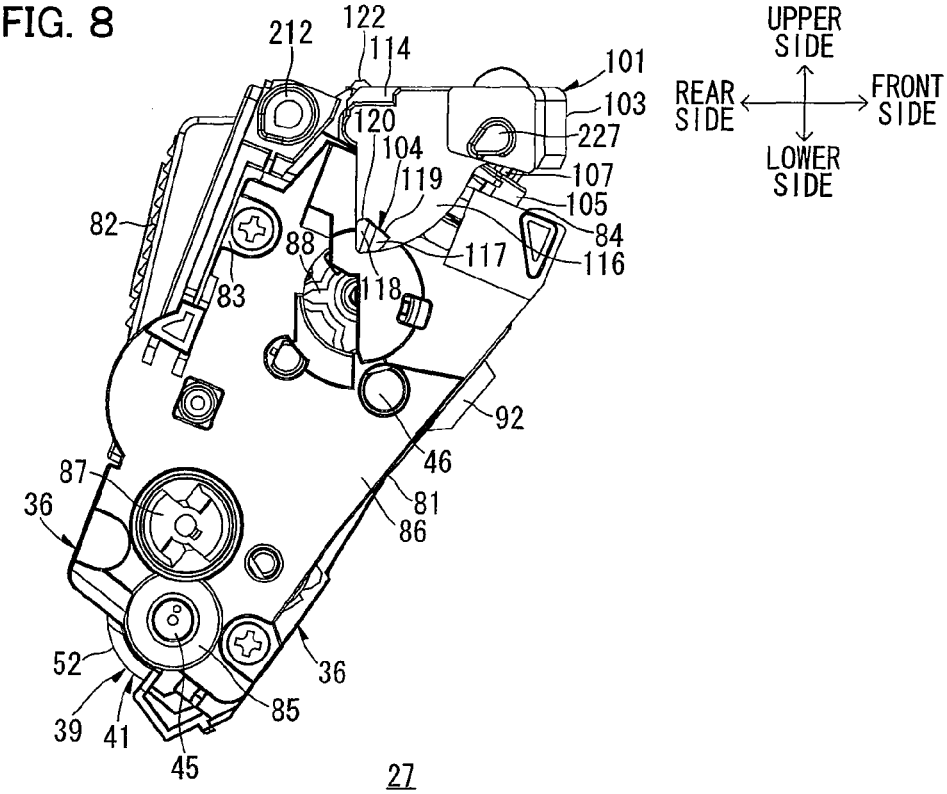
FIG. 8 is a left side view of the developer cartridge.
Figure 9:
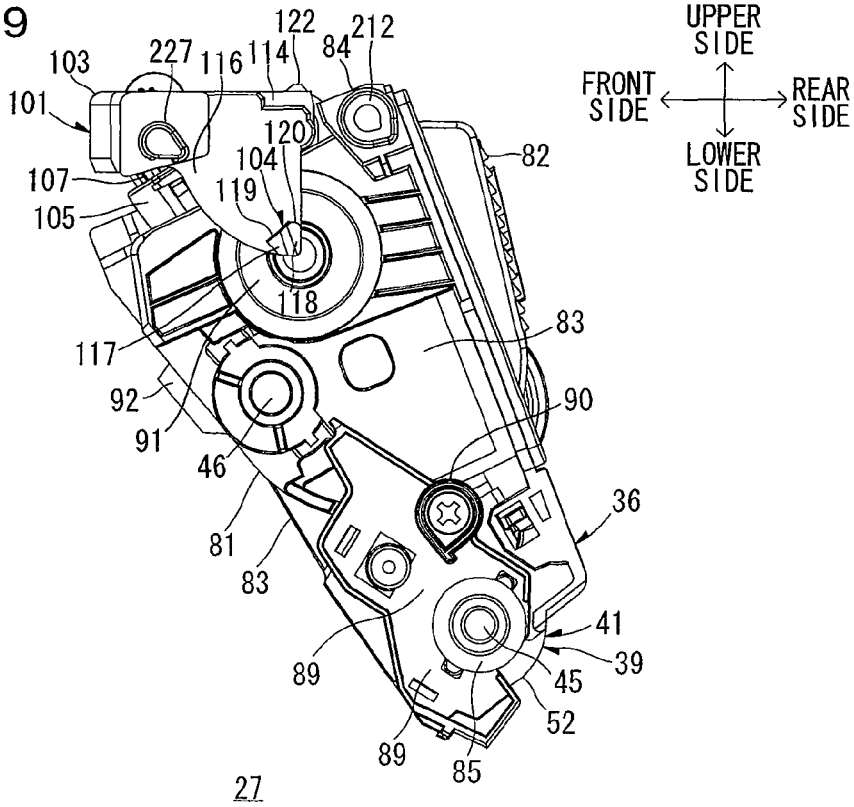
FIG. 9 is a right side view of the developer cartridge.
Figure 10:
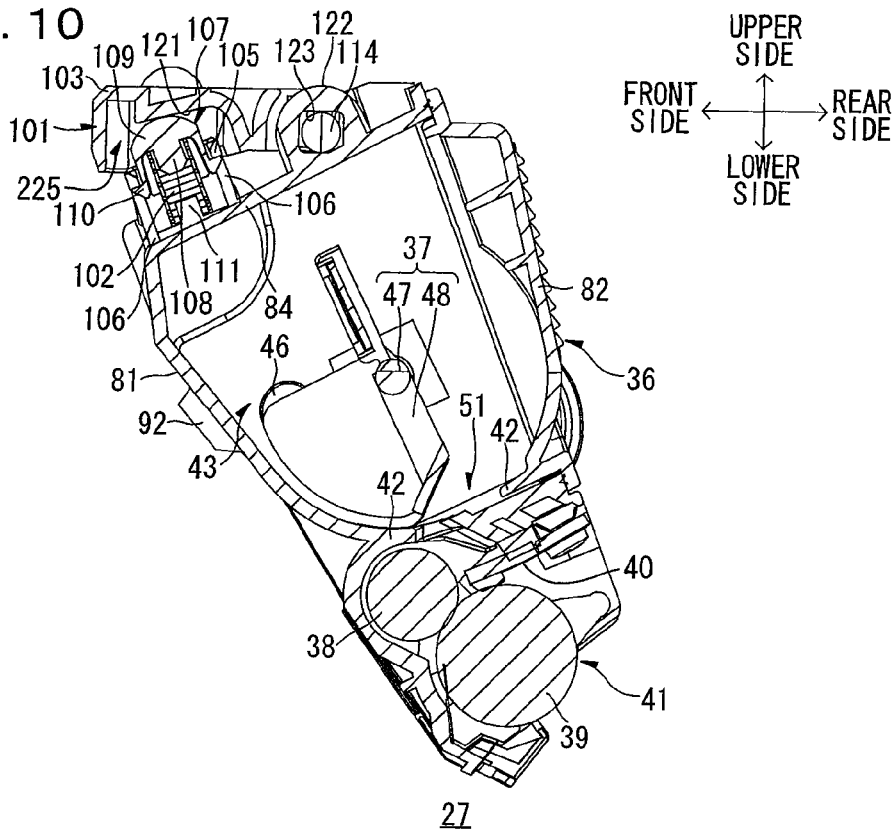
FIG. 10 is a sectional view of the developer cartridge in a non-pressed state.
Figure 11:
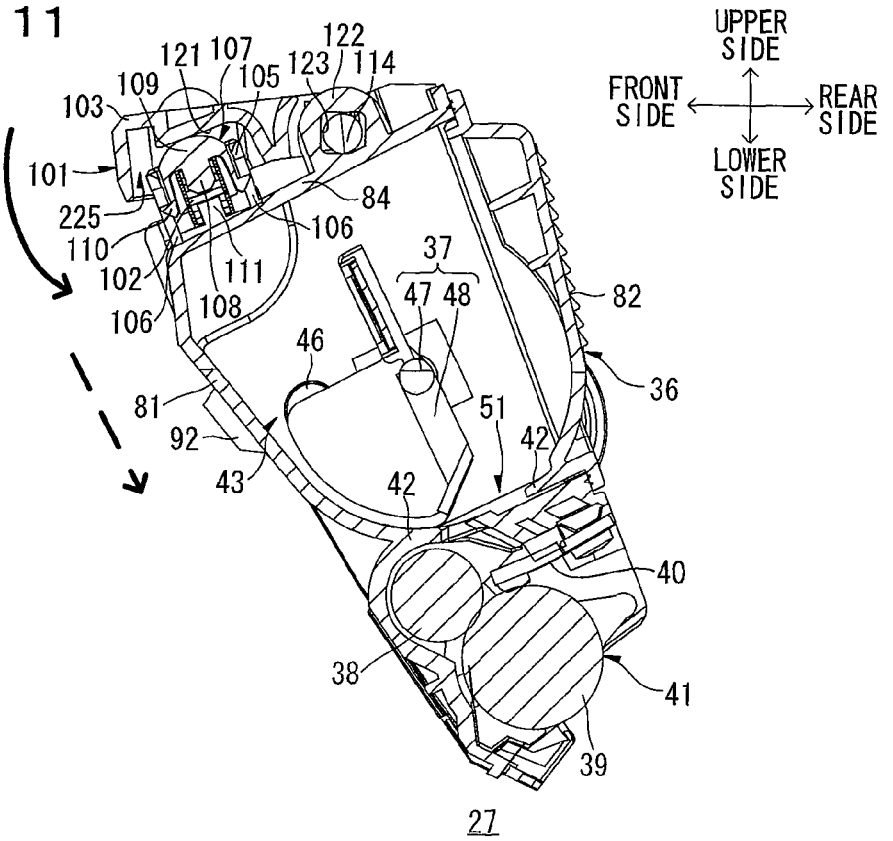
FIG. 11 is a sectional view of the developer cartridge in a pressed state.

FIG. 3 is a perspective view of the developer cartridge. FIG. 4 is a rear view of the developer cartridge. FIG. 5 is a front view of the developer cartridge. FIG. 6 is a plan view of the developer cartridge. FIG. 7 is a bottom view of the developer cartridge. FIG. 8 is a left side view of the developer cartridge. FIG. 9 is a right side view of the developer cartridge. FIG. 10 is a sectional view of the developer cartridge in a non-pressed state. FIG. 11 is a sectional view of the developer cartridge in a pressed state.

With reference to FIGS. 3 to 11, the developer cartridge is described hereinafter in greater detail.

(1) Developer Frame

As described above and shown in FIG. 4, the developer frame 36 is formed in a box shape with the opening 41 formed in the lower end portion thereof, and integrally includes a pair of the side walls 83 disposed in opposed spaced relation in the width direction, an upper wall 84 extending between the upper end edges of the both side walls 83, a front wall 81 extending between the front end edges of the both side walls 83 (see FIG. 5), and a rear wall 82 extending between the rear end edges of the both side walls 83.

The lower end edges of the both side walls 83, the front wall 81 and the rear wall 82 define the opening 41 which exposes the developing roller 39, as shown in FIGS. 4 and 5.

The developing roller shaft 45 is rotatably supported on the both side walls 83 of the developer frame 36, and the both axial end portions of the developing roller shaft 45 protrude from the respective side walls 83 in the width direction, as shown in FIG. 4. Each of the both axial end portions of the developing roller shaft 45 is covered with an electrically conductive collar member 85.

The upper end portion of the respective side wall 83 is formed with a spacing projection 212 as an example of a spacing portion. The spacing projection 212 is formed in a generally cylindrical shape and protrudes laterally outward from a connecting portion between the upper end portion of the side wall 83 and the upper end portion of the rear wall 82. As described later, the spacing projection 212 is applied with a pressing force from a later described spacing/pressuring mechanism 303 of the main body casing 2.

The developer frame 36 includes a gear mechanism (not shown) and a gear cover 86 for covering the gear mechanism on the left side wall 83, as shown in FIG. 8.

The gear mechanism (not shown) includes a coupling gear 87 and a gear train (not shown). The gear train includes an agitator driving gear which meshes with the agitator rotating shaft 47 (see FIG. 2) of the agitator 37, a feed roller driving gear which meshes with the feed roller shaft 49 (see FIG. 2) of the feed roller 38, a developing roller driving gear which meshes with the developing roller shaft 45 of the developing roller 39, and a detection gear 88, all of which mesh with the coupling gear 87 via an intermediate gear and the like.

This coupling gear 87 is coupled with a coupling shaft (not shown) provided in the main body casing 2 in movable and relatively non-rotatable manner. A driving force from a motor (not shown) provided in the main body casing 2 is transmitted to the coupling gear 87 via this coupling shaft. The driving force is transmitted from the coupling gear 87 to the agitator driving gear, the feed roller driving gear, the developing roller driving gear and the detection gear 88, and thereby rotating the agitator rotating shaft 47, the feed roller shaft 49, and the developing roller shaft 45. The detection gear 88 is formed as a partially non-toothed gear and determines whether the developer cartridge 27 is old or new based on whether the gear rotates or not.

The gear cover 86 has openings to expose the coupling gear 87 and the detection gear 88, and provided on the left side wall 83 so as to expose the coupling gear 87 and the detection gear 88 from the openings and to cover the gear train.

The developer frame 36 includes an electrically conductive current supply member 89 on the right side wall 83, as shown in FIG. 9. This current supply member 89 supports the developing roller shaft 45 of the developing roller 39 between the right side wall 83 and the collar member 85 so that the developing roller shaft 45 is slidable, and integrally includes a contacting plate 90 which protrudes laterally outward.

The contacting plate 90 is applied with a developing bias from a power source (not shown) provided in the main body casing 2. This developing bias is applied to the developing roller shaft 45 via the current supply member 89.

The right side wall 83 is provided with a cap 91 above the detection window 46 to block a toner filling opening (not shown) for filling the toner in the toner accommodation chamber 43.

The developer frame 36 is provided with positioning convex portions 92 on both end portions of the front wall 81 in the right and left direction, as shown in FIG. 5. The positioning convex portions 92 are formed in a generally trapezoidal shape as viewed from the side (see FIGS. 8 and 9) and protrude forward from the front wall 81.

(2) Attachment/Detachment Operating Portion

The developer frame 36 is provided with an attachment/detachment operating member 101 to attach and detach the developer cartridge 27, as shown in FIG. 3.

This attachment/detachment operating member 101 is provided on the upper wall 84 of the developer frame 36, and includes a spring 102 (see FIG. 10) and an abutting member 107 (see FIG. 10), the grip 103 as an example of a pivoting member for pressing the spring 102 and the abutting member 107 toward the developing roller 39, and a fitting projection 104 provided on the grip 103.

The front end portion of the upper wall 84 is formed with two spring receiving cylinders 105 which are disposed at an interval generally equal to the lateral length (length in the axial direction) of the rubber roller 52 of the developing roller 39 on the respective end portions on the upper wall 84 in the width direction (direction identical with the axial direction of the developing roller 39), as shown in FIGS. 5 and 10.

Each spring receiving cylinder 105 is in a cylindrical shape and protrudes upward from the upper wall 84. In each spring receiving cylinder 105, a plurality of fixing grooves 106 are formed in a spaced relation in the circumferential direction thereof and extend from the lower end portion to the midway portion of the spring receiving cylinder 105 in the up-and-down direction.

Further, each spring receiving cylinder 105 is provided with a mounting boss 111 which has a diameter smaller than the spring receiving cylinder 105 and is provided in a spaced relation to the internal circumferential surface of the spring receiving cylinder 105. This mounting boss 111 is in a cylindrical shape and protrudes upward from the upper wall 84.

Moreover, each spring receiving cylinder 105 is provided with the spring 102, and the abutting member 107 which fits to the spring 102 and can move in the up-and-down direction.

The spring 102 is a coil spring (compression spring), inserted between the internal circumferential surface of the spring receiving cylinder 105 and the mounting boss 111, and disposed in the lower portion of the spring receiving cylinder 105.

The abutting member 107 integrally includes a boss portion 108, and a head portion 109 bulging in the radial direction from the upper end portion of the boss portion 108. In addition, the circumferential end portion of the head portion 109 is formed integrally with a plurality of hook-shaped hook portions 110 extending downward corresponding to the respective fixing grooves 106.

In the abutting member 107, the boss portion 108 is disposed on the spring 102 in the upper portion of the spring receiving cylinder 105, the head portion 109 is disposed on the spring receiving cylinder 105, and the hook portion 110 is fixed to the fixing groove 106 of the spring receiving cylinder 105 in a slidable manner in the up-and-down direction.

The abutting member 107 is normally urged upward by the spring 102, while the hook portion 110 thereof is fixed to the upper end portion of the fixing groove 106, thereby preventing the abutting member 107 from being detached from the spring receiving cylinder 105.

The grip 103 is formed in a thin plate shape extending in the width direction and the rear end portion thereof is integrally formed with two grip mounting portion 112 in a spaced relation to each other in the respective lateral end portions, as shown in FIG. 3.

Each grip mounting portion 112 is formed with a notched portion 113 which is notched forward from the rear end edge of the grip 103 in a generally rectangular shape as viewed from the top. From the inner side walls of the notched portion 113, elastically deformable swinging shafts 114 respectively protrude toward the direction toward which they come close to each other (inward in the width direction), as shown in FIG. 6.

The grip 103 is formed with a pressing projection 227 on each of both lateral end portions in the front end portion, as an example of a pressuring portion, which is formed in a generally columnar shape as viewed from the side and protrudes laterally outward. As described later, the pressing projection 227 is applied with a pressing force from the spacing/pressuring mechanism 303 described later in the main body casing 2. Moreover, the pressing projection 227 is formed such that the tip surface thereof is flush anteroposteriorly with the tip end face of the spacing projection 212 protruding on the same side, as shown in FIG. 6.

The grip 103 is formed with a grasp hole 115, which is formed in an elongated rectangular shape as viewed from the top and extends in the width direction, in the center portion thereof in the width direction, as shown in FIG. 3. At the time of attaching and detaching operation of the developer cartridge 27, the operator's fingers are inserted in this grasp hole 115 to grasp the grip 103.

Moreover, on the lower surface (opposed surface to the upper wall 84) of the grip 103, a recess 225 which can receive each abutting member 107, is formed at a position inward of the upper wall 84 in the width direction and opposite to the abutting member 107, as shown in FIGS. 5 and 10. Each recess 225 is formed in a generally circular shape as seen form the rear so as to be able to receive the abutting member 107.

The grip 103 is provided with a projection support plate 116 bending downward from each of the both end edges thereof in the width direction.

Each projection support plate 116 is formed in a fan-shape as viewed from the side and provided with the fitting projection 104 in the lower end portion thereof, as shown in FIGS. 8 and 9.

Each fitting projection 104 is formed in a generally triangular shape which tapers down, as viewed from the side (more specifically, generally diamond shape whose upper end edge is formed as a reversed V-shape), and protrudes laterally outward from the lower end portion of the projection support plate 116.

Each fitting projection 104 is formed with a front-side inclined surface 117 in which the end face of the front end portion of the fitting projection 104 inclines inward in the width direction and forward from the center portion of the fitting projection 104 in the anteroposterior direction (in other words, inclines toward a pivot plane as an example of a first plane including the later described pivoting direction of the grip 103 and an axial plane as an example of a second plane including the axial direction (width direction) and orthogonal to the pivot plane, as shown in FIG. 3.

Further, the end face of the rear end portion of the fitting projection 104 is formed as a rear-side inclined surface 118 which inclines inward in the width direction and backward from the center portion of the fitting projection 104 in the anteroposterior direction, in other words, inclines toward the pivot plane including the pivoting direction of the grip 103 and the axial plane including the axial direction (width direction) orthogonal to the pivot plane.

Furthermore, the end face of the upper end portion of the fitting projection 104 is formed by a front end face 119 and a rear end face 120 having different angles, as shown in FIGS. 8 and 9. The front end face 119 and the rear end face 120 are gradually spaced apart outward in the anteroposterior direction and inclined downward from the center portion in the anteroposterior direction, as viewed from the side. The front end face 119 and the rear end face 120 are each formed flat along the width direction as a right angle surface which bends at a generally right angle from the side surface of the center portion of the fitting projection 104 in the anteroposterior direction.

The rear end portion of the upper wall 84 is provided with two grip support portions 122 on the both end portions thereof in the width direction corresponding to the grip mounting portions 112, as shown in FIGS. 3 and 10.

Each grip support portion 122 is formed in a generally U-shape as viewed from the side formed with a penetration hole 123 along the width direction, and extends in the width direction.

By bringing the swinging shaft 114 of each grip mounting portion 112 into abutment against the corresponding grip support part 122 while elastically deforming and fitting the swinging shaft 114 to the corresponding penetration hole 123, the grip 103 is allowed to be pivotably supported on the upper wall 84 of the developer frame 36 with the width direction as a pivoting axis. More specifically, the grip 103 is supported around the swinging shaft 114 so as to be pivotable to a standing state where the grip 103 stands generally orthogonal to the upper wall 84 (see FIG. 20), an inclined state where the grip 103 inclines forward of the standing state and is adjacent to the upper wall 84 (see FIGS. 8, 9, 10 and the black developer cartridge 27K shown in FIG. 21), and a pressing state where the grip 103 is more adjacent to the upper wall 84 than the inclined state (see FIG. 11 and the yellow developer cartridge 27Y shown in FIG. 21).

In the following description, with referring to FIGS. 20 and 21, one of the pivoting directions of the grip 103 is referred to as a pressing direction (direction indicated by a solid arrow in the drawing) in which the grip 103 pivots from the standing state via the inclined state to the pressing state in the clockwise direction, and the direction opposite to the pressing direction, that is, the pivoting direction from the pressed state via the inclined state to the standing state, is referred to as a pressure releasing direction.

When the grip 103 is in the standing state (see FIG. 20), the distance between the upper side surface of a flange portion 155 (described later) and the upper end edge of the grip 103 is referred to as "A". On the other hand, when the grip 103 is in the inclined state (see FIG. 21), the distance between the upper side surface of the flange portion 155 and the upper end edge of the grip 103 is referred to as "B".

As shown in FIGS. 10 and 11, when the grip 103 is in the inclined state or in the pressing state, each recess 225 of the grip 103 contacts the corresponding abutting member 107. On the other hand, when the grip 103 pivots from the inclined state in the pressure releasing direction, each recess 225 of the grip 103 is spaced apart from the abutting member 107.

3. Drum Unit

Figure 12:
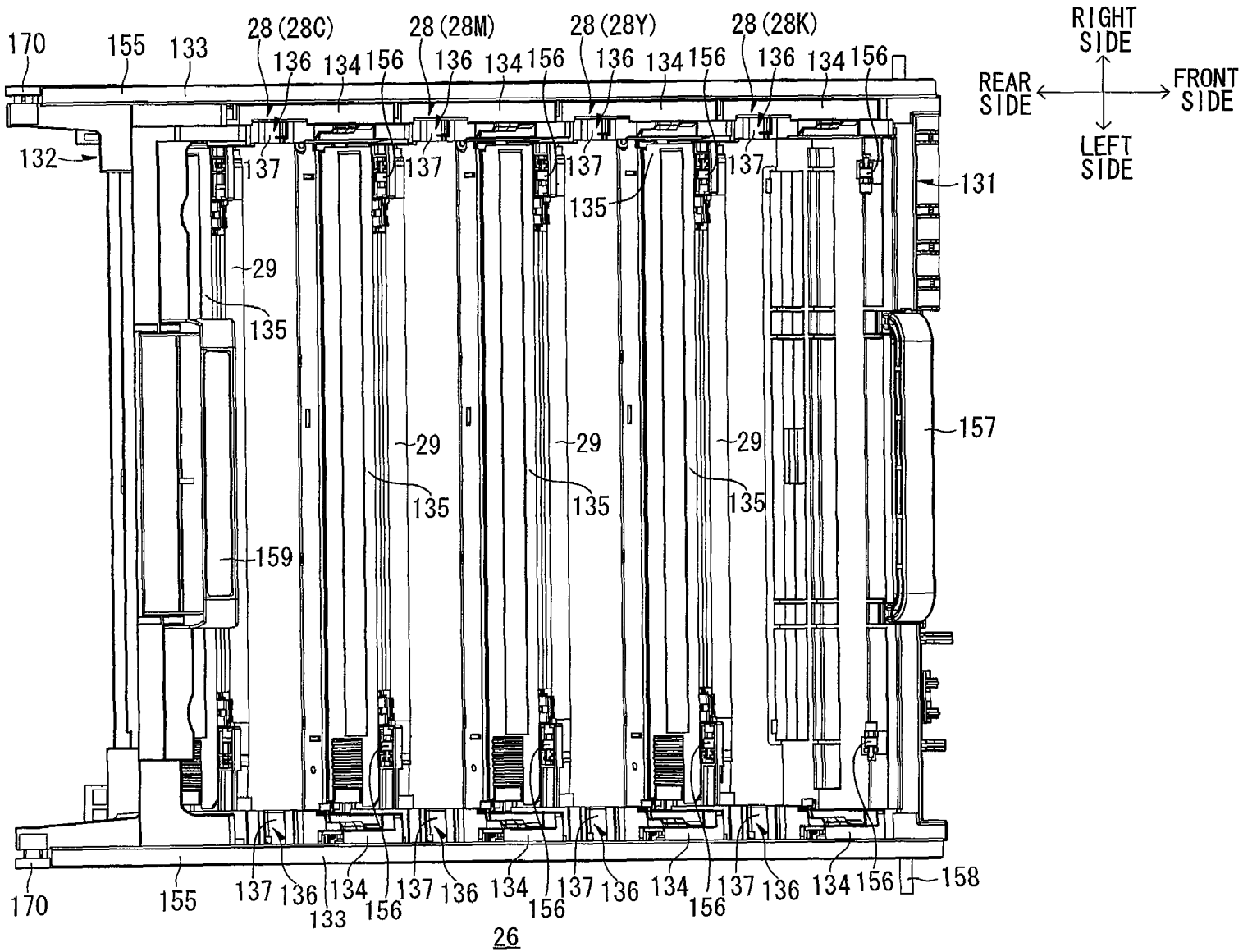
FIG. 12 is a plan view of a drum unit.
Figure 13:
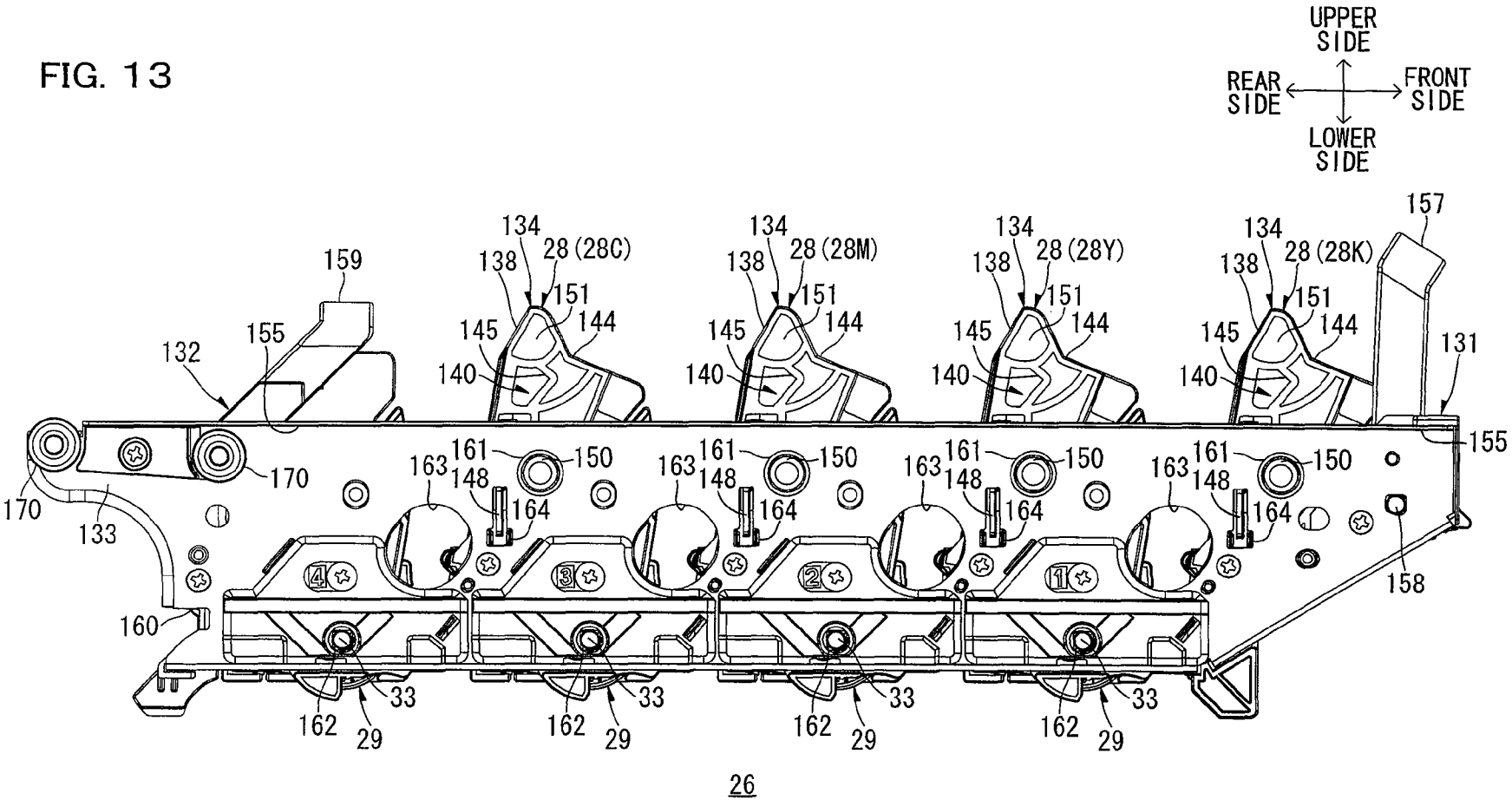
FIG. 13 is a left side view of the drum unit.
Figure 14:
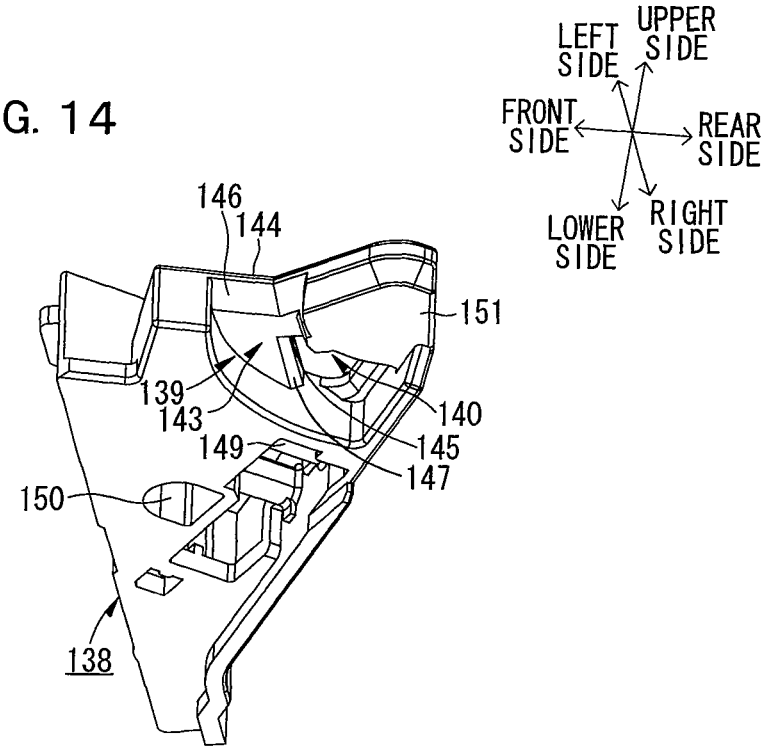
FIG. 14 is a perspective view of a left side frame in the portion forward of a guide groove as viewed from the upper right front.
Figure 15:
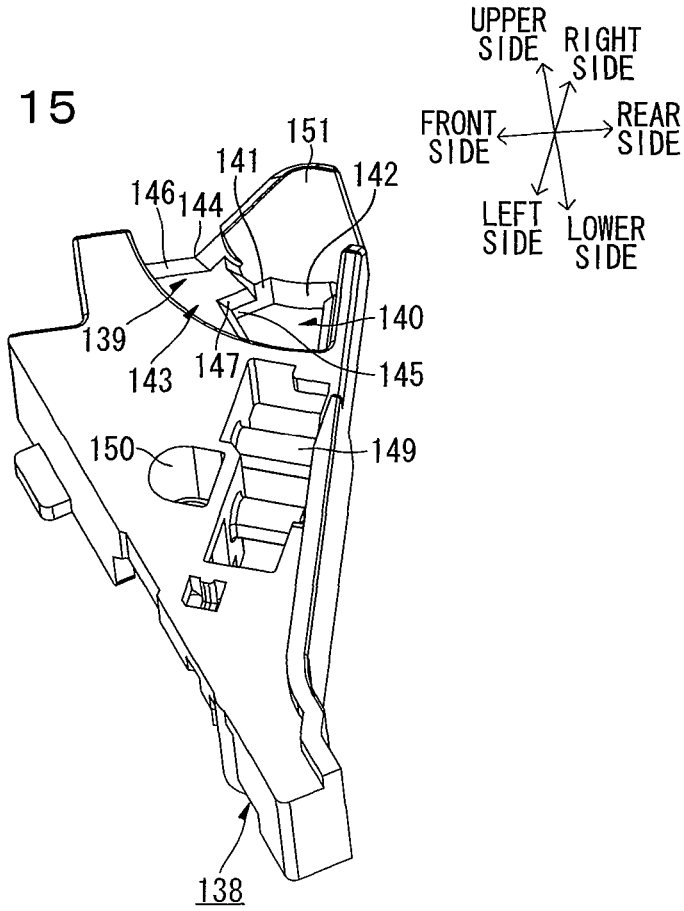
FIG. 15 is a perspective view of the left side frame in the portion forward of the guide groove as viewed from the lower right front.
Figure 16:
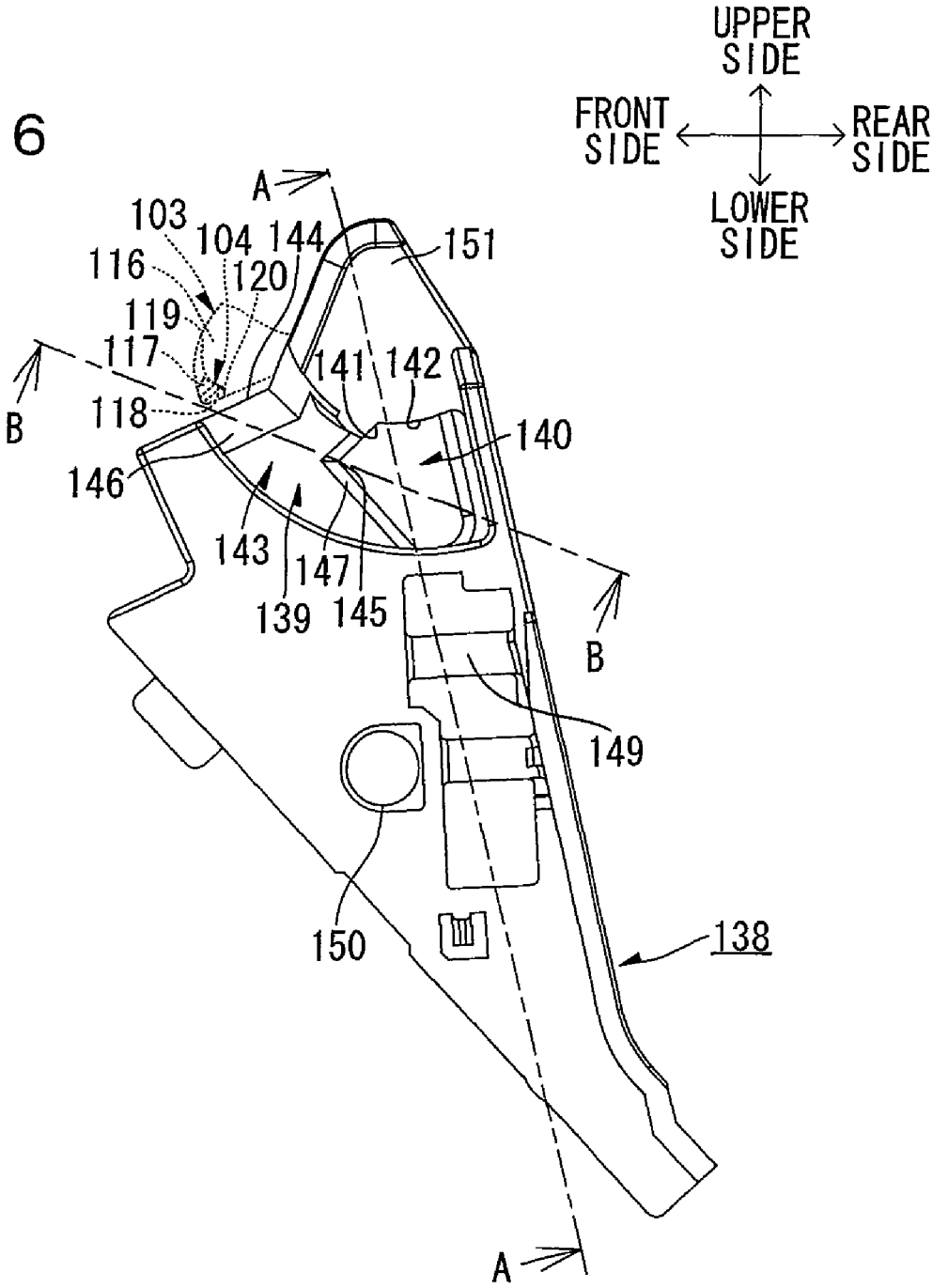
FIG. 16 is a right side view of the left side frame in the portion forward of the guide groove. A fitting projection is shown in a dotted line for reference.
Figure 17:
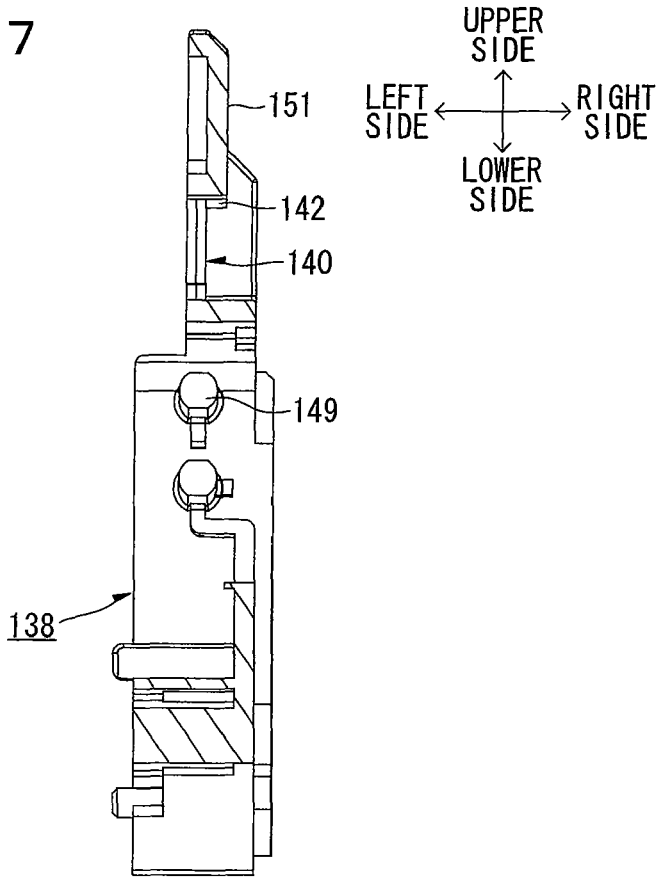
FIG. 17 is a view taken along a line A-A viewed in an arrow direction A in FIG. 16.
Figure 18:
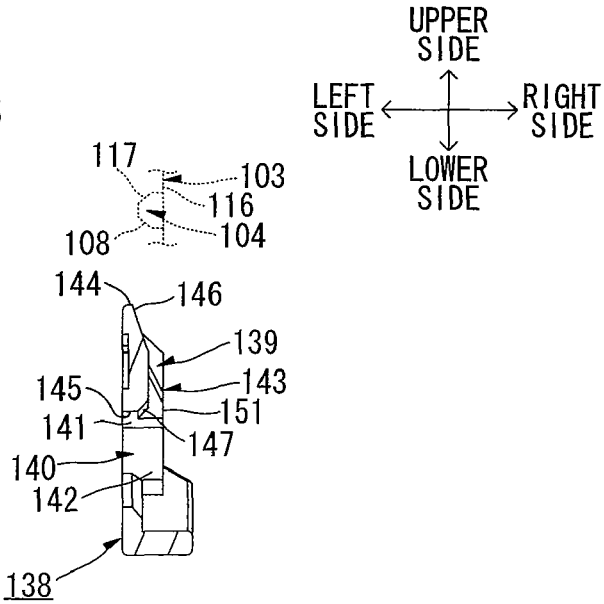
FIG. 18 is a view taken along a line B-B viewed in an arrow direction B in FIG. 16. The fitting projection is shown in a dotted line for reference.
Figure 19:
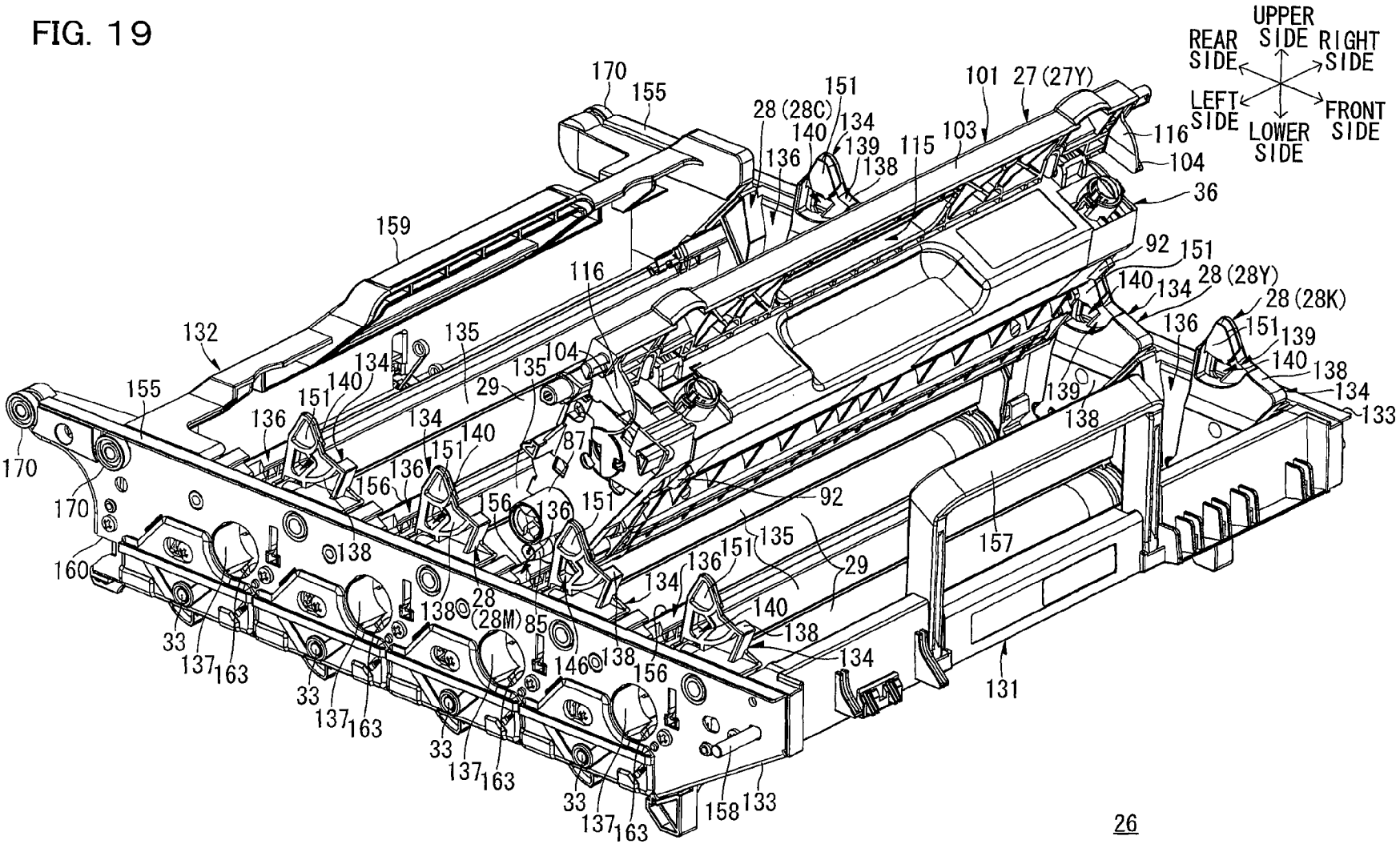
FIG. 19 is a perspective view of the drum unit (in a state where one developer cartridge is being attached and the other developer cartridges have been detached) as viewed from the upper left front.

FIG. 12 is a plan view of the drum unit. FIG. 13 is a left side view of the drum unit. FIG. 14 is a perspective view of the portion of the left side frame forward of a guide groove as viewed from the upper right front. FIG. 15 is a perspective view of the portion of the left side frame forward of the guide groove as viewed from the lower right front. FIG. 16 is a right side view of the portion of the left side frame forward of the guide groove (the fitting projection is shown in a dotted line for reference). FIG. 17 is a view taken along a line A-A viewed in an arrow direction A in FIG. 16. FIG. 18 is a view taken along a line B-B viewed in an arrow direction B in FIG. 16 (the fitting projection is shown in a dotted line for reference). FIG. 19 is a perspective view of the drum unit (in a state where one developer cartridge is being attached and the other developer cartridges had been detached) as viewed from the upper left front. FIG. 20 is a left side view of the drum unit in a state where one developer cartridge (in a state where the grip stands) is attached. FIG. 21 is a left side view of the drum unit in a state where developer cartridges (in a state where the respective grip is laid down) are attached.

With reference to FIGS. 12 to 21, the drum unit is described hereinafter in detail.

This drum unit 26 includes the four drum subunits 28 disposed in parallel along the anteroposterior direction and corresponding to each color, a front beam 131 and a rear beam 132 disposed on both sides of the four drum subunits 28 in the anteroposterior direction, and the pair of side plates 133 which sandwich the front beam 131, the four drum subunits 28 and the rear beam 132 from both sides in the width direction (right and left direction), as shown in FIG. 12.

The drum unit 26 is composed integrally of four drum subunits 28, the front beam 131, the rear beam 132 and the pair of side plates 133, and is detachably attachable to the drum receiving space 7 (refer to FIG. 1) in the main body casing 2 in a slidable manner.

(1) Drum Subunit

Each drum subunit 28 includes the pair of side frames 134 disposed in an opposed spaced relation in the width direction, and the center frame 135 extending between the both side frames 134 along the width direction, as shown in FIGS. 12 and 19.

(1-1) Side Frame

Each side frame 134 is formed of a resin material and formed in a flat plate shape as shown in FIG. 19. Each side frame 134 is inserted through by the drum shaft 33 of the photosensitive drum 29.

Each side frame 134 is formed with a cartridge guide groove 136 for guiding the attaching and detaching of the developer cartridge 27 to and from the drum subunit 28.

This cartridge guide groove 136 is formed to extend along the generally up-and-down direction from the rear-side upper end edge of the side frame 134 to the vicinity of the front-side lower end portion of the side frame 134, specifically, formed to extend obliquely downwardly rearward. The lower end portion (the deepest portion) of the cartridge guide groove 136 is disposed corresponding to the position of the developing roller shaft 45 at the position where the developing roller 39 contacts the photosensitive drum 29. The collar member 85 is slidably received by the cartridge guide groove 136.

In addition, the left side frame 134 is formed with a coupling inner insertion hole 137 which is opposed to the coupling gear 87 of the developer cartridge 27 in the width direction. This coupling inner insertion hole 137 is formed as a round hole penetrating the left side frame 134 in the thickness direction.

In each of the right and left side frames 134, the portion forward of the cartridge guide groove 136 (hereinafter referred to as a front portion 138) is formed in a generally triangular shape as viewed from the side which tapers downward.

The rear end portion of the front portion 138 is formed with a protruding portion 151 protruding upward, and the upper end edge on the front side of the front portion 138 continuing with the protruding portion 151 is formed flat.

Below the protruding portion 151, a fitting hole 140 is formed as an example of a fit portion.

This fitting hole 140 penetrates the front portion 138 in the thickness direction (width direction), and is formed in a generally triangular shape which tapers downward as viewed from the side, (more specifically, generally diamond shape whose upper end edge is formed as a reversed V-shape), as shown in FIG. 16. This fitting hole 140 is formed in a similar figure around several times (two to four times) larger than the fitting projection 104 of the developer cartridge 27 as viewed from the side (see FIG. 21).

In the internal circumferential surface of the fitting hole 140, the end face of the upper end portion thereof is formed by an upper front end face 141 and an upper rear end face 142 having different angles, as shown in FIG. 15. More specifically, the upper front end face 141 and the upper rear end face 142 are gradually spaced apart outward in the anteroposterior direction from the center portion as viewed from the side, and the upper rear end face 142 extends in the horizontal direction (anteroposterior direction) and the upper front end face 141 inclines downward, as shown in FIG. 16.

As described later, the upper front end surface 141 and the upper rear end surface 142 are opposed to the front end face 119 and the rear end face 120 of the upper end portion of the fitting projection 104, respectively, in the state where the fitting projection 104 is loosely fit in the fitting hole 140 (refer to FIG. 21), and formed flat in the direction orthogonal to the opposed direction (except the front end portion of the upper front end face 141, as described next), as shown in FIG. 17. That is, each of the upper front end face 141 and the upper rear end face 142 is formed flat along the width direction as a right angle surface which bends at generally right angle from the internal surface of the front portion 138 in the vicinity of the fitting hole 140. Each of the upper front end face 141 (except the front end portion) and the upper rear end face 142 is formed such that the length thereof in the width direction is equal to that (thickness) of the protruding portion 151.

As shown in FIG. 16, in the front portion 138, a portion between a generally V-shape portion 144 (referred to hereinafter as an "upper V-shape portion 144") and a generally V-shape portion 145 (referred to herein after as a "lower V-shape portion 145"), serves as a passing portion 143. The upper V-shape portion 144 is formed by the front end portion of the protruding portion 151 and the rear side portion of the upper end edge of the front portion 138 continuing the protruding portion 151. The lower V-shape portion 145 is formed by the front end portion of the upper front end face 141 and the front side portion of the front end edge of the internal circumferential surface of the fitting hole 140 continuing the front end portion of the upper front end face 141. Described later, the fitting projection 104 traverses the passing portion 143 when the fitting projection 104 is loosely fitted in the fitting hole 140 or this loose fitting is released by the pivot of the grip 103.

This passing portion 143 is formed with a projection guide groove 139 as an example of a guide groove that guides the passage of the fitting projection 104.

This projection guide groove 139 is formed in a circular arc along the pivot path of the fitting projection 104 as viewed from the side and formed as a gutter-shaped passage which concaves laterally outward from the internal surface of the front portion 138, as shown in FIGS. 14 and 15. Specifically, the lateral length (thickness) of the front portion 138 in the projection guide groove 139 is formed shorter than the lateral lengths (thicknesses) of the upper front end face 141 (except the front end portion) and the upper rear end face 142 (that is, the lateral length of the protruding portion 151.

In the projection guide groove 139, as shown in FIGS. 14 and 18, the end face of the upper end portion continuing from the upper V-shape portion 144 is formed as an upper inclined surface 146 which inclines laterally outward and upwardly from the midway portion of the projection guide groove 139 in the up-and-down direction, in other words, the upper inclined surface 146 inclines with respect to the pivot plane including the pivoting direction of the grip 103 and the axial plane including the axial direction (width direction) orthogonal to the pivot plane.

In the projection guide groove 139, as shown in FIGS. 15 and 18, the end face of the lower end portion continuing from the lower V-shape portion 145 is formed as a lower inclined surface 147 which inclines laterally outward and downwardly from the midway portion of the projection guide groove 139 in the up-and-down direction, in other words, the lower inclined surface 147 inclines with respect to the pivot plane including the pivoting direction of the grip 103 and the axial plane including the axial direction (width direction) orthogonal to the pivot plane.

The front portion 138 is provided with a lever support portion 149, to which a detection lever 148 (see FIG. 13) interlocking with the detection gear 88 is swingably supported, below the projection guide groove 139, as shown in FIG. 16.

In the front portion 138, a light passing boss 150 formed in a columnar shape and protruding laterally outward is formed on the front side of the lever support portion 149. This light passing boss 150 is opposed to the detection window 46 in the width direction in the state where the developer cartridge 27 is attached in the drum unit 26.

(1-2) Center Frame

The center frame 135 is formed of a resin material and formed in a flat plate shape extending in the width direction, as shown in FIGS. 12 and 19. The center frame 135 supports the scorotron charger 30 and the cleaning brush 31 (see FIG. 2), as described above. The upper end portion of the center frame 135 is provided with a guide roller 156 for guiding the attaching and detaching of the developer cartridge 27 on each of both lateral end portions.

(2) Front Beam

The front beam 131 is molded integrally from a resin material, is disposed on the front side of the four drum subunits 28 which are disposed in parallel along the anteroposterior direction, and extends between the pair of side plates 133, as shown in FIGS. 12 and 19.

This front beam 131 includes a front-side grasp portion 157 attached in the center portion in the width direction, and a support shaft 158 for pivotably supporting the front-side grasp portion 157.

The support shaft 158 is disposed so as to penetrate the front beam 131 along the width direction and supported by the front beam 131.

Figure 20:
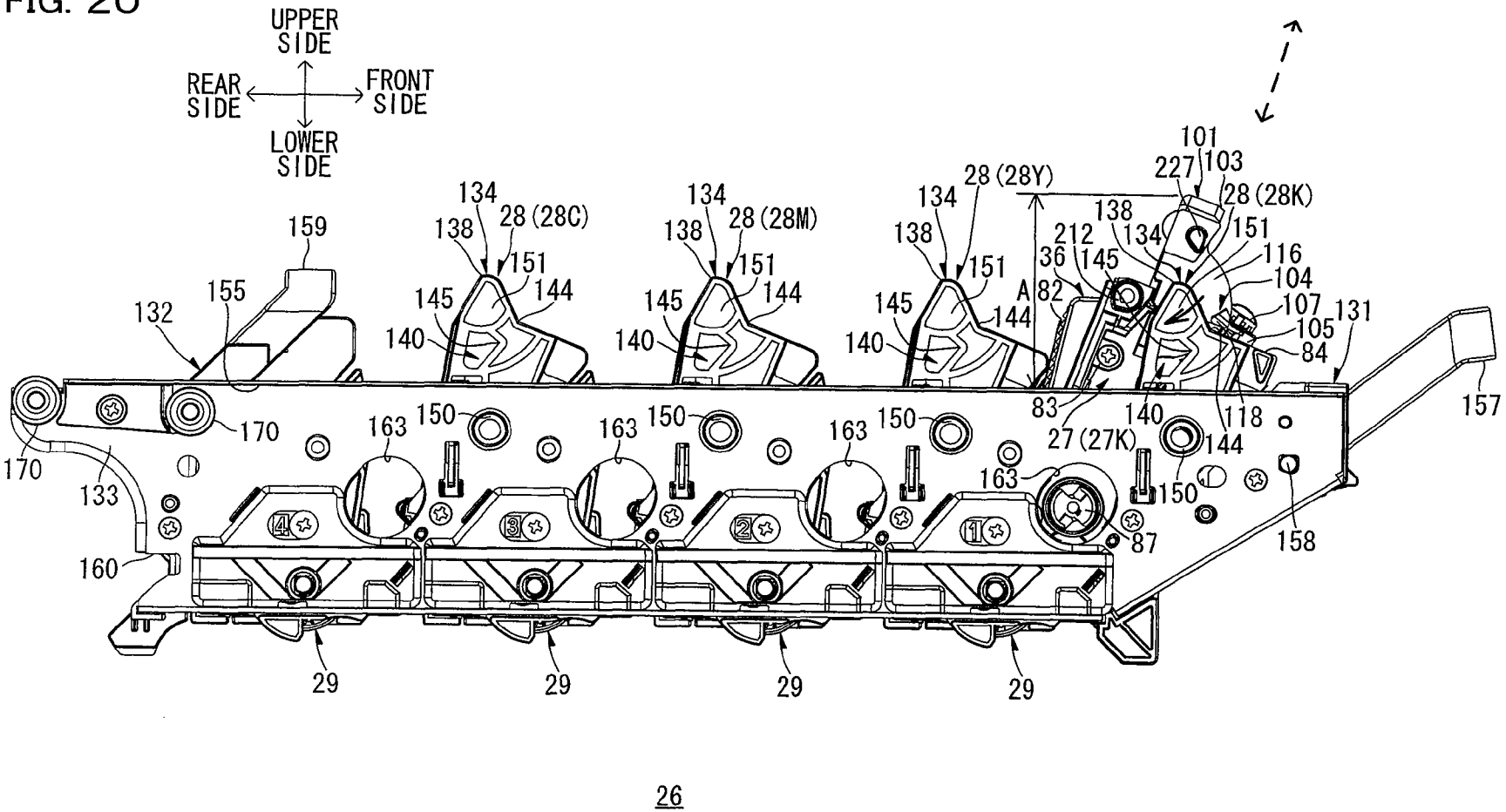
FIG. 20 is a left side view of the drum unit in which one developer cartridge (in a state where a grip stands) is in the attached state.

The front-side grasp portion 157 is formed in a generally U-shape with each distal end thereof pivotably supported by the support shaft 158 at the center in the width direction, and is swingable to a storage position where the front-side grasp portion 157 stands along the front beam 131 (see FIG. 13) and an operating position where the front-side grasp portion 157 inclines to the front side of the front beam 131 (see FIG. 20).

(3) Rear Beam

The rear beam 132 is molded integrally from a resin material, is disposed on the rear side of the four drum subunits 28 which are disposed in parallel along the anteroposterior direction, and extends between the pair of side plates 133.

This rear beam 132 is formed in a generally U-shape as seen from above, with the rear side thereof opened, and integrally provided with a back-side grasp portion 159 at the center thereof in the width direction.

The back-side grasp portion 159 is formed in a generally U-shape as viewed from the back, and each distal end thereof is coupled with the rear beam 132, and the back-side grasp portion 159 inclines from the lower rear side to the upper front side, and protrudes obliquely upward from the rear beam 132.

(4) Side Plate

It is preferred that each side plate 133 is formed of a material which is more rigid than a resin material forming the drum subunit 28, the front beam 131 and the rear beam 132, such as a metal or a fiber reinforced resin, and preferably each side plate 133 is formed of steel plate.

Each side plate 133 is formed in an elongated rectangular plate shape as viewed from the side, and with respect to the front beam 131, the four drum subunits 28 and the rear beam 132 disposed in parallel in the anteroposterior direction, the front end portion thereof is opposed and fixed to the front beam 131 and the rear end portion thereof is opposed and fixed to the rear beam 132, as shown in FIG. 13.

The rear end portion of each side plate 133 is formed with a notched portion 160 which is notched from the rear end edge of the side plate 133 in a generally U-shape as viewed from the side. The notched portion 160 is fitted by a positioning shaft (not shown) provided in the main body casing 2 in the state where the drum unit 26 is attached in the main body casing 2, whereby the drum unit 26 is positioned with respect to the main body casing 2.

The upper end portion of each side plate 133 is formed with the flange portion 155 which is bent laterally outward and extends laterally outward across the anteroposterior direction so as to have a L-shaped section. This flange portion 155 extends straight along the anteroposterior direction.

The rear end portion of each side plate 133 has the upper end portion extending backward and formed in a generally L-shape as viewed from the side. The portion which extends backward includes two roller members 170 in a rotatable manner. These two roller members 170 are disposed in the anteroposterior direction with a spacer sandwiched therebetween. The front roller member 170 is disposed below the flange portion 155 and the rear roller member 170 is disposed in back of the rear end portion of the flange portion 155.

In the upper end portion of each side plate 133, four light passing holes 161 each receiving the light passing boss 150 of the drum subunit 28 is formed corresponding to the light passing boss 150. The light passing hole 161 is fitted by the corresponding light passing 150 so that the light passing boss 150 is exposed laterally outward, thereby restricting the pivot of the drum subunit 28 with respect to the side plate 133 around the drum shaft 33.

The lower end portion of each side plate 133 is formed with shaft holes 162 for being inserted through by the axial end portion of each drum shaft 33.

The left side plate 133 is formed with coupling outer insertion holes 163 opposed to the corresponding coupling gear 87 of each developer cartridge 27 in the width direction.

On the rear side of each light passing hole 161 in the left side plate 133, a lever passing hole 164 is formed. The lever passing hole 164 is opposed to the lever support portion 149 of the left side frame 134 in the width direction and has one end portion of the detection lever 148 exposed laterally outward.

The detection lever 148 exposed from the lever passing hole 164 swings along with the rotation of the detection gear 88. A detection sensor (not shown) provided in the main body casing 2 determines whether the developer cartridge 27 is old or new based on whether the detection lever 148 is detected or not.

4. Attaching and Detaching of Developer Cartridge to and from Drum Unit (1) Attaching of Developer Cartridge to Drum Unit To attach each developer cartridge 27 to the drum unit 26, for example, the grip 103 is held by placing fingers into the grasp hole 115 of the grip 103 of the developer cartridge 27 corresponding to each color. At this time, the grip 103 is pivoted in the pressure releasing direction and located in the standing state.

Then, the held developer cartridge 27 is attached to the corresponding drum subunit 28 from above the drum unit 26, as shown in FIG. 19.

More specifically, the collar member 85 that covers each of the both axial end portions of the developing roller shaft 51 of the developer cartridge 27 is inserted in the cartridge guide groove 136 of the side frame 134 of the corresponding drum subunit 28. The developer cartridge 27 is then pushed obliquely downwardly rearward into the drum subunit 28 along the cartridge guide groove 136.

When the developing roller 39 contacts the photosensitive drum 29, further pushing of the developer cartridge 27 is restricted. Thereafter, the developer cartridge 27 inclines around the developing roller shaft 51 by its own weight toward a direction toward which the upper end portion thereof leans against the front center frame 135, and each positioning projection 92 of the developer frame 36 abuts against and is supported by the guide roller 156 of the center frame 135. This allows the developer cartridge 27 to be positioned with respect to the drum subunit 28, and the developer cartridge 27 is thus completely attached in the drum subunit 28.

Next, while the grip 103 is kept being held or released from the hand by its own weight, the grip 103 is pivoted to the pressing direction (see the illustrated solid arrow) intersecting the attaching and detaching direction (see the illustrated dotted arrow) of the developer cartridge 27 to and from the drum subunit 28, each fitting projection 104 of the grip 103 is brought into abutment against the corresponding upper V-shaped portion 144 of the front portion 138 of the side frame 134, as shown in FIG. 20. Accordingly, the pivot of the grip 103 in the pressing direction is temporarily restricted.

Afterwards, when the grip 103 is further pivoted in the pressing direction while the grip 103 is held, each fitting projection 104 of the grip 103 shown in FIG. 18, is guided in the projection guide groove 139 while the rear-side inclined surface 118 thereof is sliding on the upper inclined surface 146 (the pressing direction shown in FIG. 18 is a downward direction). At this time, since each fitting projection 104 moves inward in the width direction along the inclined direction of the upper inclined surface 146, the projection support plate 116 provided with the fitting projection 104 deflects inward in the width direction in accordance with the movement of the fitting projection 104.

When the grip 103 further pivots in the pressing direction, each fitting projection 104 passes the projection guide groove 139 while sliding in the projection guide groove 139, and the front-side inclined surface 117 thereof is opposed to the lower inclined surface 147.

Further pivot of the grip 103 in the pressing direction guides each fitting projection 104 of the grip 103 in the corresponding fitting hole 140 while the front-side inclined surface 117 thereof slides on and contacts the lower inclined surface 147. At this time, since each fitting projection 104 moves laterally outward along the inclined direction of the lower inclined surface 147, the projection support plate 116 provided with the fitting projection 104 moves back laterally outward in accordance with the movement of the fitting projection 104.

Figure 21:
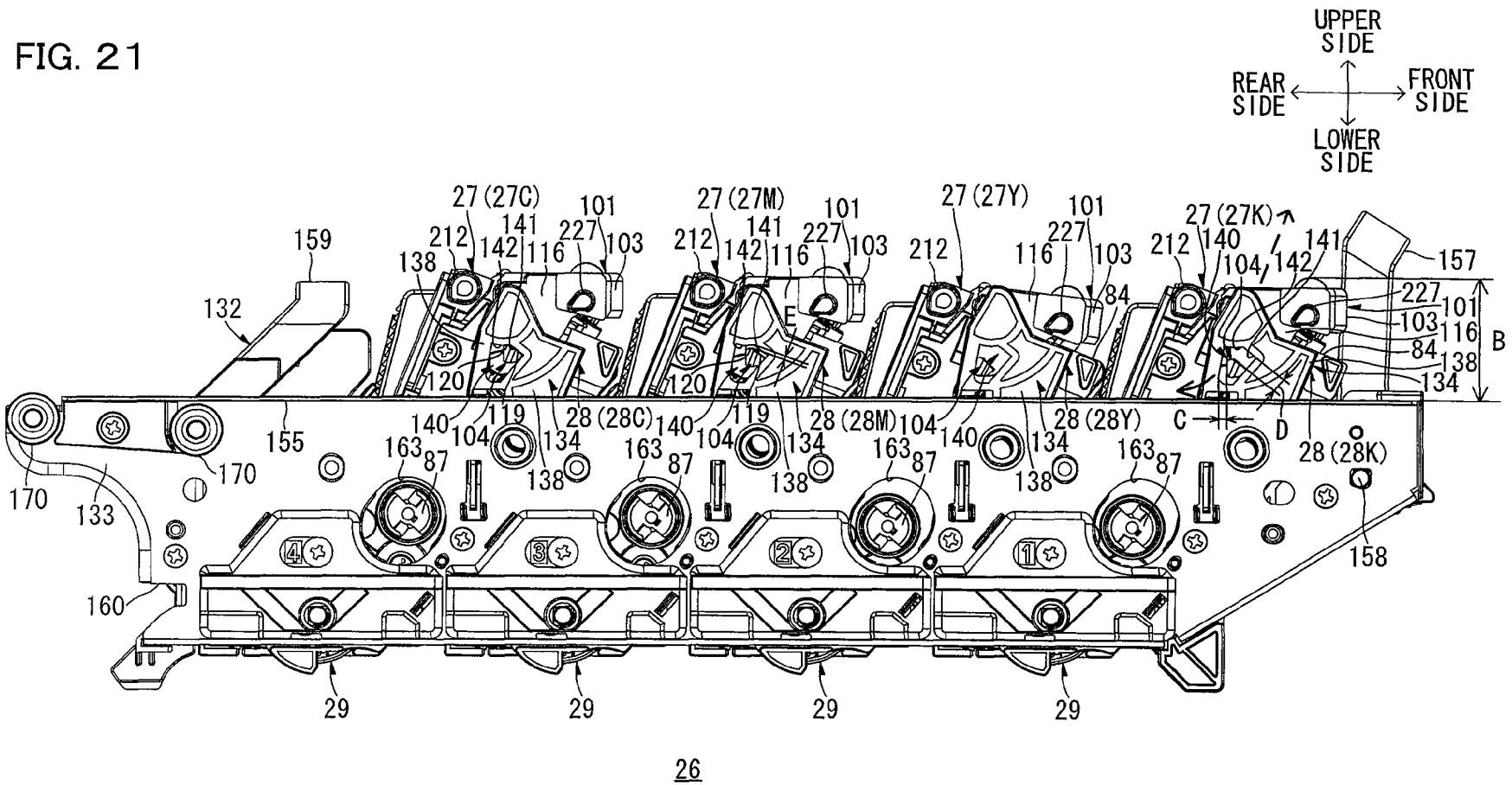
FIG. 21 is a left side view of the drum unit in which developer cartridges (in a state where each grip is laid down) are in the attached state.

The fitting projection 104 guided inside the corresponding fitting hole 140 is then fitted loosely into each fitting hole 140, as shown by the black developer cartridge 27K in FIG. 21. In other words, the fitting projection 104 is fitted to the corresponding side frame 134. At this time, the grip 103 is in the inclined state. As mentioned above, the fitting hole 140 is formed in a similar figure around several times (two to four times) larger than the fitting projection 104 as viewed from the side. Therefore, in the state where the fitting projection 104 is loosely fit in the fitting hole 140, the fitting projection 104 is allowed to move along the pivot direction of the grip 103, that is, the pressing direction (see the illustrated solid arrow) and the pressure releasing direction (the direction opposite to the direction illustrated by the solid arrow), and also along the attaching and detaching direction of the developer cartridge 27, that is, a direction obliquely upwardly forward (see the illustrated dotted arrow, referred to hereinafter as a "spacing direction") and the direction obliquely downwardly rearward (referred to hereinafter as a "space releasing direction"). In the following description, the spacing direction and the space releasing direction are collectively referred to as a "intersecting direction".

Specifically, a first gap C is formed between each fitting projection 104 that is in the loosely fitted in the fitting hole 140, and the end portion of the internal circumferential surface of the fitting hole 140 (rear end portion) on the downstream side in the pressing direction, on the downstream side of the fitting projection 104 in the pressing direction. On the downstream side of each fitting projection 104 in the spacing direction, a second gap D is formed between the fitting projection 104 which is in the loosely fitted in the fitting hole 140, and the end portions of the internal circumferential surface in the fitting hole 140 on the downstream side in the spacing direction (the upper front end face 141 and the upper rear end face 142).

In the following description, the position of the fitting projection 104 where it is loosely fitted in the fitting hole 140 while maintaining the first gap C and the second gap D, is referred to as a "releasing position". When the fitting projection 104 is in the releasing position, the pressing projection 227 and the spacing projection 212 of the developer cartridge 27 are not applied with a pressing force and the developing roller 39 slightly contacts the photosensitive drum 29.

When the grip 103 in the inclined state is further pivoted to the pressing direction in the state where the fitting projection 104 is in the releasing position, the fitting projection 104 moves in the pressing direction in accordance with this pivot. When the first gap C is closed, the fitting projection 104 abuts against the end portion of the internal circumferential surface of the fitting hole 140 on the downstream side in the pressing direction, and further movement of the fitting projection 104 and the grip 103 toward the pressing direction is restricted, as shown by the yellow developer cartridge 27Y in FIG. 21. In the following description, the position of the fitting projection 104 at this time is referred to as a "pressing position". When the fitting projection 104 is at the pressing position, the grip 103 is in the pressing state and presses the developing roller 39 against the photosensitive drum 29, as described later. In other words, the gap C is set as a moving distance of the grip 103 and the fitting projection 104 toward the pressing direction, which is the minimum requirement for pressing the developing roller 39 against the photosensitive drum 29 when the fitting projection 104 is in the releasing position.

Even attempting to detach the developer cartridge 27 from the drum subunit 28 toward the spacing direction (obliquely upwardly forward) in the state where each fitting projection 104 is loosely fitted in the fitting hole 140, the upper front end face 141 and the upper rear end face 142 of each fitting hole 140, and the front end surface 119 and the rear end face 120 of each fitting projection 104, respectively, abut against each other in the direction orthogonal to their opposed direction, in the spacing direction (detaching direction of the developer cartridge 27), as shown by the cyan developer cartridge 27C in FIG. 21. This abutment prevents the detaching of the developer cartridge 27 from the drum subunit 28. In the following description, the position of the fitting projection 104 in this state where the second gap D is closed, is referred to as a "restricting position".

A position that is away by a distance E (see the magenta developer cartridge 27M in FIG. 21) toward the space releasing direction (obliquely downwardly rearward) from the restricting position, is referred to as a "spacing position." When the fitting projection 104 is in the spacing position, the developing roller 39 is spaced apart from the photosensitive drum 29, as described later. In other words, the value in which a distance E is subtracted from the gap D, is set as a moving distance of the developer cartridge 27 including the fitting projection 104 toward the spacing direction, which is the minimum requirement for spacing the developing roller 39 from the photosensitive drum 29 when the fitting projection 104 is in the releasing position.

(2) Detaching of Developer Cartridge from Drum Unit

On the contrary, to detach the developer cartridge 27 from the drum subunit 28, first, the grip 103 is held and pivoted in the pressure releasing direction. This releases the loose fitting of the fitting projection 104 in the corresponding fitting hole 140, that is, the fitting to the corresponding side frame 134 is released. Each fitting projection 104 of the grip 103 shown in FIG. 18 is then guided into the corresponding projection guide groove 139 while the front-side inclined surface 117 thereof is sliding on the lower inclined surface 147 (the pressure releasing direction in FIG. 18 is an upward direction). At this time, each fitting projection 104 moves inward in the width direction along the inclined direction of the lower inclined surface 147, the projection support plate 116 provided with the fitting projection 104 deflects inward in the width direction in accordance with the movement of the fitting projection 104.

When the grip 103 further pivots in the pressure releasing direction, each fitting projection 104 passes the projection guide groove 139 while sliding in the projection guide groove 139, and the rear-side inclined surface 118 thereof is opposed to the corresponding upper inclined surface 146.

Further pivot of the grip 103 in the pressure releasing direction guides each fitting projection 104 of the grip 103 to above the upper V-shape portion 144 while the rear-side inclined surface 118 thereof slides on and contacts the upper inclined surface 146. At this time, since each fitting projection 104 moves laterally outward along the inclined direction of the upper inclined surface 146, the projection support plate 116 provided with the fitting projection 104 moves back laterally outward in accordance with the movement of the fitting projection 104.

Afterwards, when the developer cartridge 27 is pulled out toward the downstream side in the detaching direction while the grip 103 is held, as shown in FIG. 19, the collar member 85 which covers each of the both axial end portions of the developing roller shaft 51 of the developer cartridge 27, is lifted upward to the obliquely upper front side along the cartridge guide groove 136 of the drum subunit 28, thereby detaching the developer cartridge 27 from the drum subunit 28.

5. Rail and Spacing/Pressuring Mechanism

Figure 22:
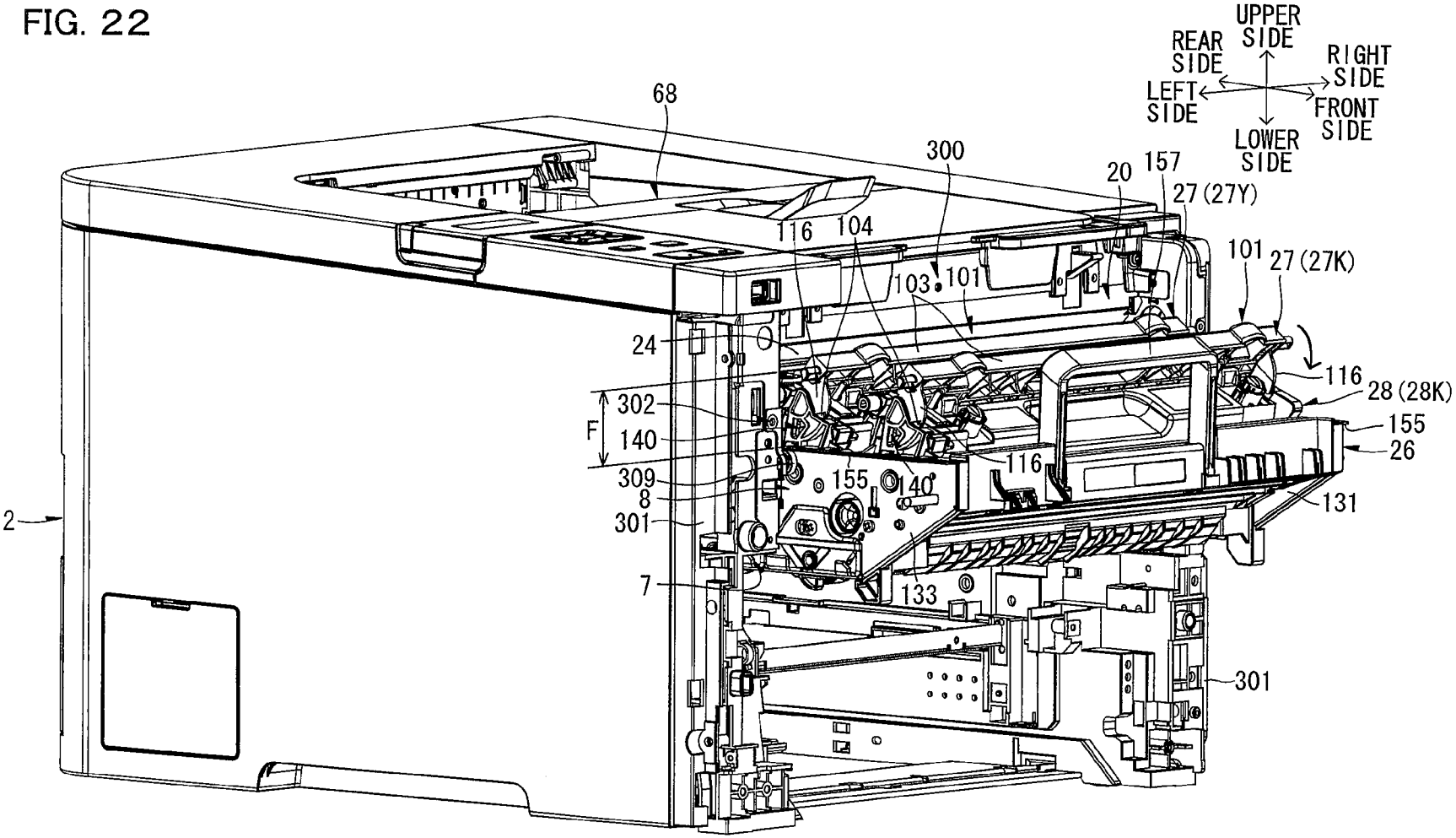
FIG. 22 is a perspective view of a main body casing and the drum unit as viewed from the upper left, and shows a state where a front cover is detached and the drum unit is being attached to the main body casing.
Figure 23:
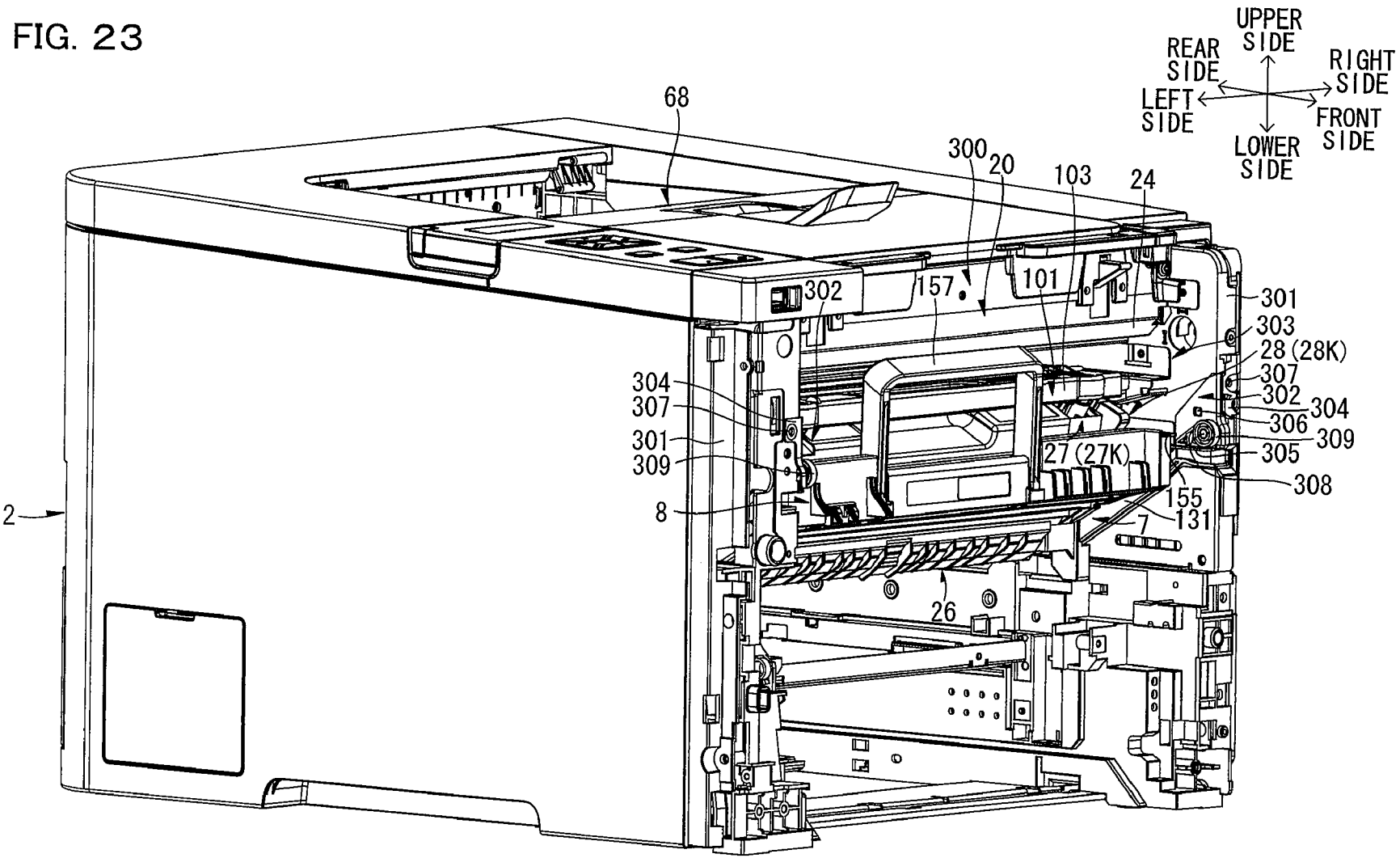
FIG. 23 shows a state where the attachment of the drum unit is completed in FIG. 22.

FIG. 22 is a perspective view of the main body casing and the drum unit as viewed from the upper left front in a state where the front cover is detached and the drum unit is being attached to the main body casing. FIG. 23 shows a state where the attachment of the drum unit is completed in FIG. 22.

The main body casings 2 includes a pair of main body frames 301 which are disposed in an opposed relation in the width direction with the drum unit 26 sandwiched therebetween, as shown in FIG. 23, and the inner surface of each main body frame 301 includes a rail 302 for guiding the attachment and detachment of the drum unit 26, and the spacing/pressuring mechanism 303 as an example of a pressing force generating unit for spacing and pressing the developing roller 39 from and against the photosensitive drum 29 by applying the pressing force on the pressing projection 227 and the spacing projection 212 of the developer cartridge 27 attached in the drum subunit 26. The above described scanning section 20 (see FIG. 1) extends between the upper end portions of the pair of main body frames 301, and the front end faces of the main body frames 301 and the front end face of the scanning section 20 define a main body front wall 300 as an example of a main body wall which is the front-side wall of the main body casing 2. The lower half portion of the front end face of the scanning section 20 is formed by the front end portion of the scanner casing 24 of the scanning section 20. The scanner casing 24 extends in the front, back, left and right directions, as described above, and the front end portion thereof first inclines obliquely upwardly forward and then extends upward. The above-described mounting port 8 (see FIG. 1) is defined by the internal front end edges of the pair of main body frames 301 and the front end edge of the lower end portion of the scanner casing 24. FIG. 23 shows only right spacing/pressuring mechanism 303.

Figure 24:
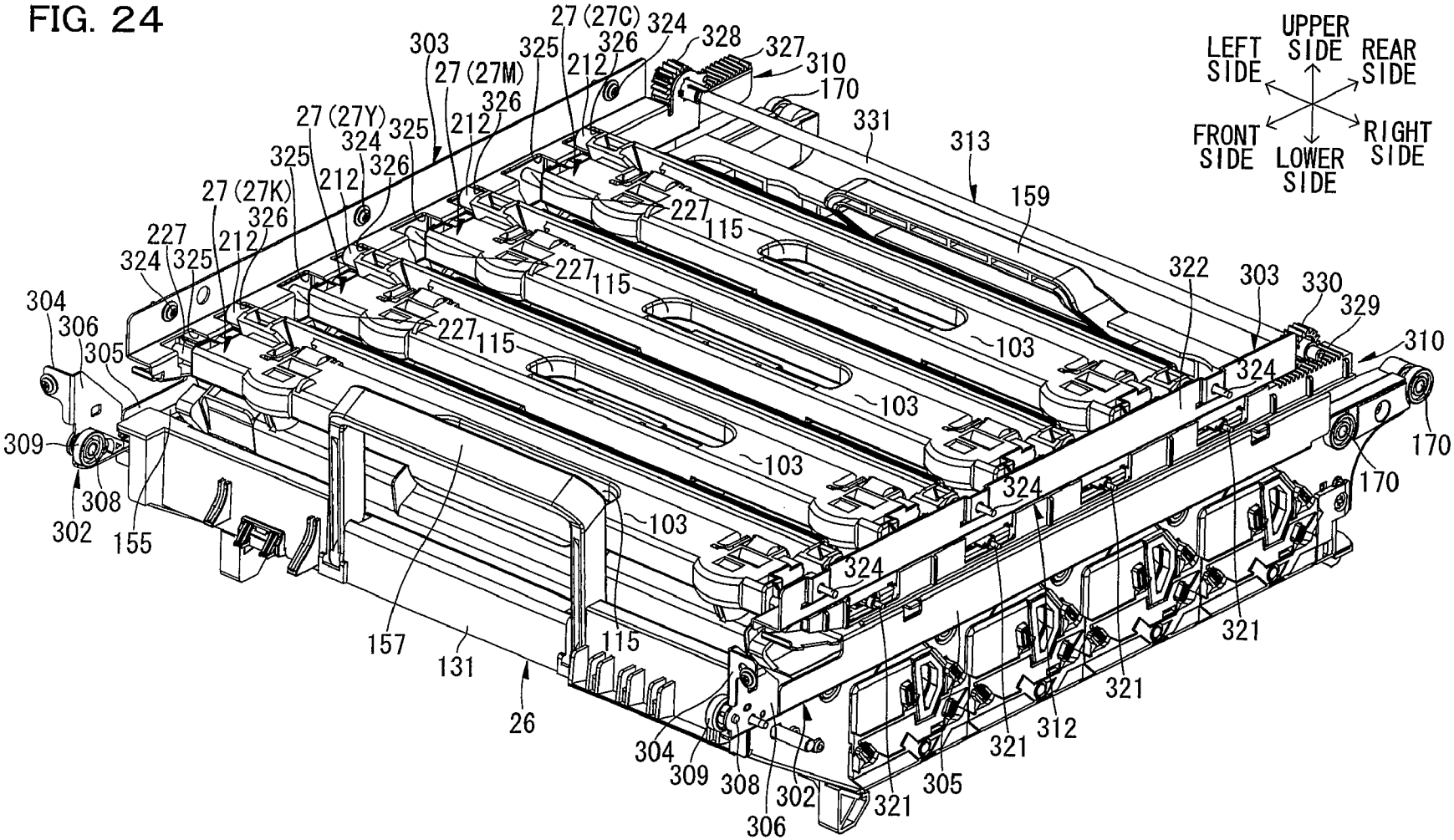
FIG. 24 is a perspective view of the drum unit, right and left rails, and a spacing/pressuring mechanism as viewed from the upper right front.
Figure 25:
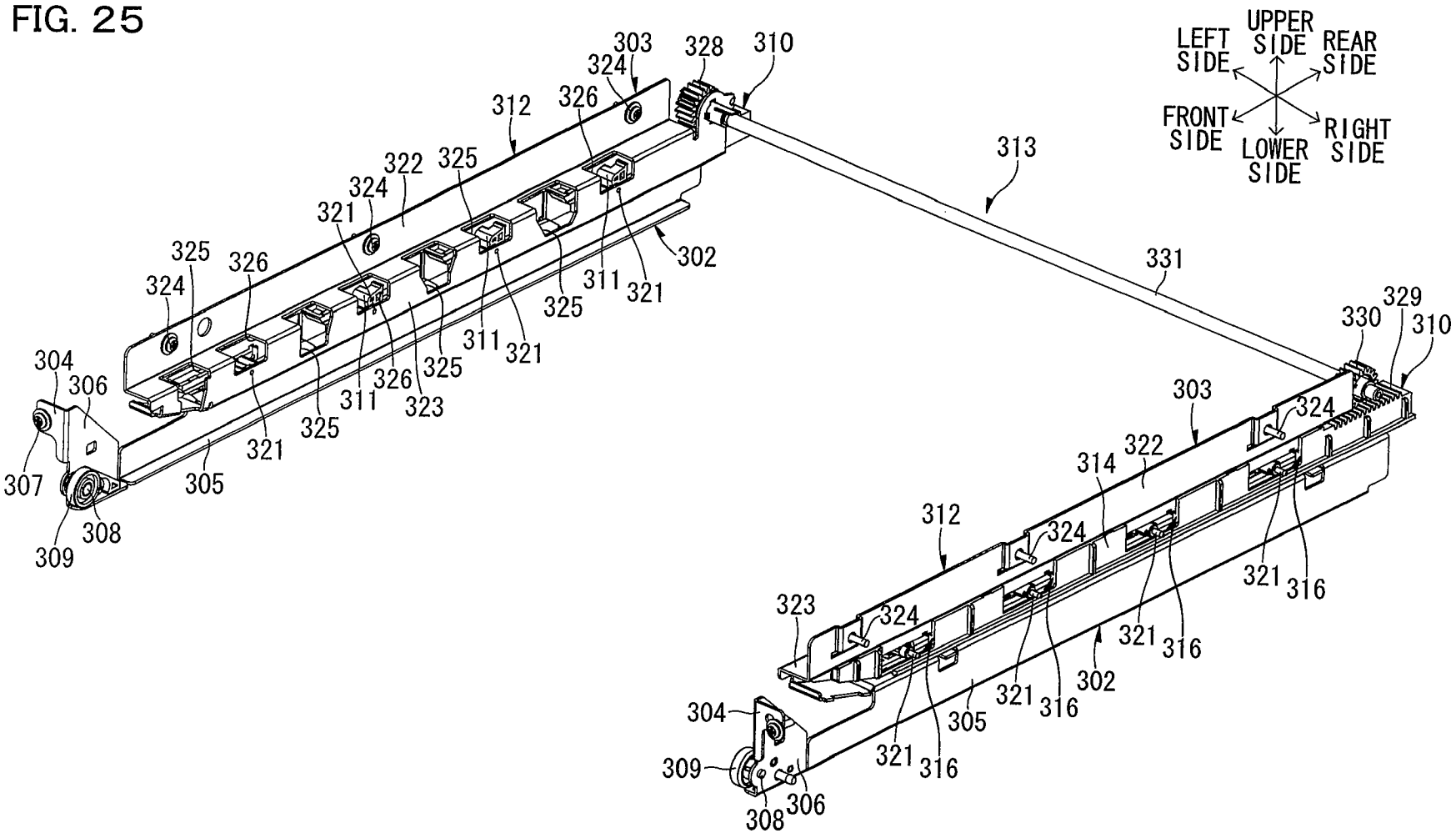
FIG. 25 is a perspective view of the right and left rails, and the spacing/pressuring mechanism as viewed from upper right front.

FIG. 24 is a perspective view of the drum unit, the right and left rails and spacing/pressuring mechanisms as viewed from the upper right front. FIG. 25 is a perspective view of the right and left rails and spacing/pressuring mechanisms as viewed from the upper right front.

(1) Rail

The right and left rails 302 are disposed in an opposed relation in the width direction with the drum unit 26 sandwiched therebetween, as shown in FIG. 24. Each rail 302 integrally includes a rail fixing portion 304 disposed in an opposed relation to the front end face of the main body frame 301 (see FIG. 23), a rail main portion 305 extending in the anteroposterior direction (horizontal direction) along the inner surface of the main body frame 301, and a connecting portion 306 which connects the rail fixing portion 304 and the rail main portion 305.

The rail fixing portion 304 is fixed to the front end face of the main body frame 301 by a screw 307, as shown in FIG. 23.

As shown in FIG. 25, the rail main portion 305 is formed in a generally L-shape as seen in section with the lower end portion thereof bent inward in the width direction, and the flange portion 155 (see FIG. 24) of each side plate 133 of the drum unit 26 is placed on the portion of the rail main portion 305 that extends horizontally in the state where the drum unit 26 attached in the main body casing 2.

The connecting portion 306 is formed so as to connect the end edge of the laterally internal side of the rail fixing portion 304 and the front end edge of the rail main portion 305. A roller support shaft 308 penetrates this connecting portion 306 in the width direction and is supported by it. On the respective inner surfaces of the connecting portion 306 in the width direction, rail rollers 309, which are pivotably supported by the roller support shaft 308, are disposed in an opposed relation to each other. The uppermost end portion of the peripheral surface of the rail roller 309 is located higher than the lower end portion (the portion that extends horizontally) of the rail main portion 305.

An interval F in the up and down direction is provided between the uppermost end portion of the peripheral surface of the rail roller 309 and the scanner casing 24 of the scanning section 20, as shown in FIG. 22. This interval F is set smaller than an interval A (see FIG. 20) and slightly larger than an interval B (see FIG. 21).

(2) Attaching of Drum Unit to Main Body Casing

To attach the drum unit 26 to the main body casing 2, the front-side grasp portion 157 and the back-side grasp portion 159 (see FIG. 19) of the drum unit 26 are held respectively by both hands and the drum unit 26 is lifted. Then, the mounting port 8 is opened by inclining the front cover 9 shown in FIG. 1, and the drum unit 26 is introduced from this mounting port 8 toward the drum receiving space 7.

At this time, each roller member 170 provided at the rear end portion of the drum unit 26 (see FIG. 19) is rolled on the rail main portion 305 of the rail 302 shown in FIG. 24. By leaving the hand from the back-side grasp portion 159, the both flange portions 155 of the drum unit 26 (see FIG. 19) are placed on the right and left rail rollers 309, respectively. In this state, when the drum unit 26 is pushed rearward as shown in FIG. 22, each roller member 170 (see FIG. 19) rolls on the rail main portion 305 (see FIG. 25) and each flange portion 155 slides on the rail roller 309. As a result, the drum unit 26 moves smoothly. Moreover the spacing projection 212 and the pressing projection 227 of each developer cartridge 27 slide on a cam receiving portion 323 of a holder fixing portion 322 described later. The grip 103 is in the standing state in FIG. 22. However, when the drum unit 26 is pushed rearward, in accordance with the size relation among the interval F, the interval A (see FIG. 20) and the interval B (see FIG. 21) (interval A>interval F>interval B), the front end portion of the scanner casing 24 of the scanning section 20 abuts against each grip 103 which is in the standing state, and each grip 103 sequentially pivots toward the inclining state on the downstream side in the pressing direction (direction shown by arrows in the drawing). In other words, the front end portion of the scanner casing 24 serves as an example of an intervening portion.

As shown in FIG. 24, when the roller member 170 drops from the rail 302 to the far side (rear side) and the flange portion 155 drops from the rail roller 309 to the far side of each rail roller 309 to be placed onto the portion of the corresponding rail main portion 305 that extends horizontally, the pressing projection 227 and the spacing projection 212 of each developer cartridge 27 are respectively received by a pressing projection receiving portion 325 and a spacing projection receiving portion 326 which are described later, and the mounting of the drum unit 26 to the main body casing 2 is completed. In this state, each fitting projection 104 of the grip 103 pivoted to the inclining state by being brought into abutment against the front end portion of the scanner casing 24 of the scanning section 20 while being attached as mentioned above, is loosely fitted to the fitting hole 140. At this time, each fitting projection 104 is in the releasing position (see the black developer cartridge 27K in FIG. 21).

After the hand is released from the front-side grasp portion 157, the front cover 9 (see FIG. 1) is closed to block the mounting port 8 with the front cover 9, as shown in FIG. 24. When the front cover 9 is closed, the front-side grasp portion 157 interlocks and pivots from the operating position (see FIG. 20) to the storage position (see FIG. 21) around the support shaft 158.

(3) Spacing/Pressuring Mechanism

The spacing/pressuring mechanism 303 includes a pair of translation cam members 310, intermediate members 311 provided for the respective translation cam members 310, cam holders 312 holding the respective translation cam members 310 so that the translation cam members 310 can move straight in the anteroposterior direction, and a synchronized movement mechanism 313 to synchronize the pair of translation cam members 310 to move straight, as shown in FIG. 25.

Figure 26:
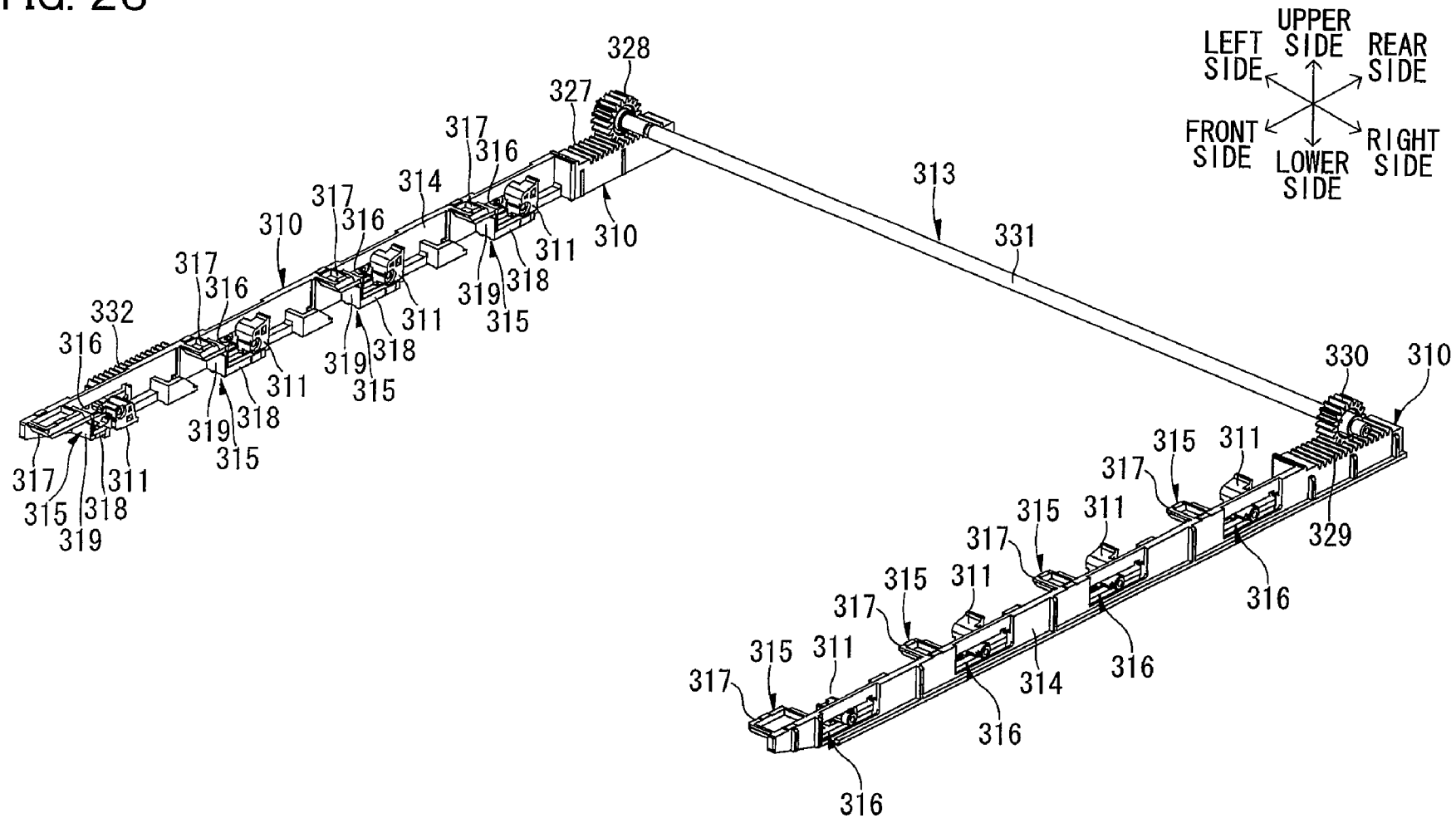
FIG. 26 is a perspective view of a translation cam member, an intermediate member and a synchronized movement mechanism as viewed from the upper right front.
Figure 27:
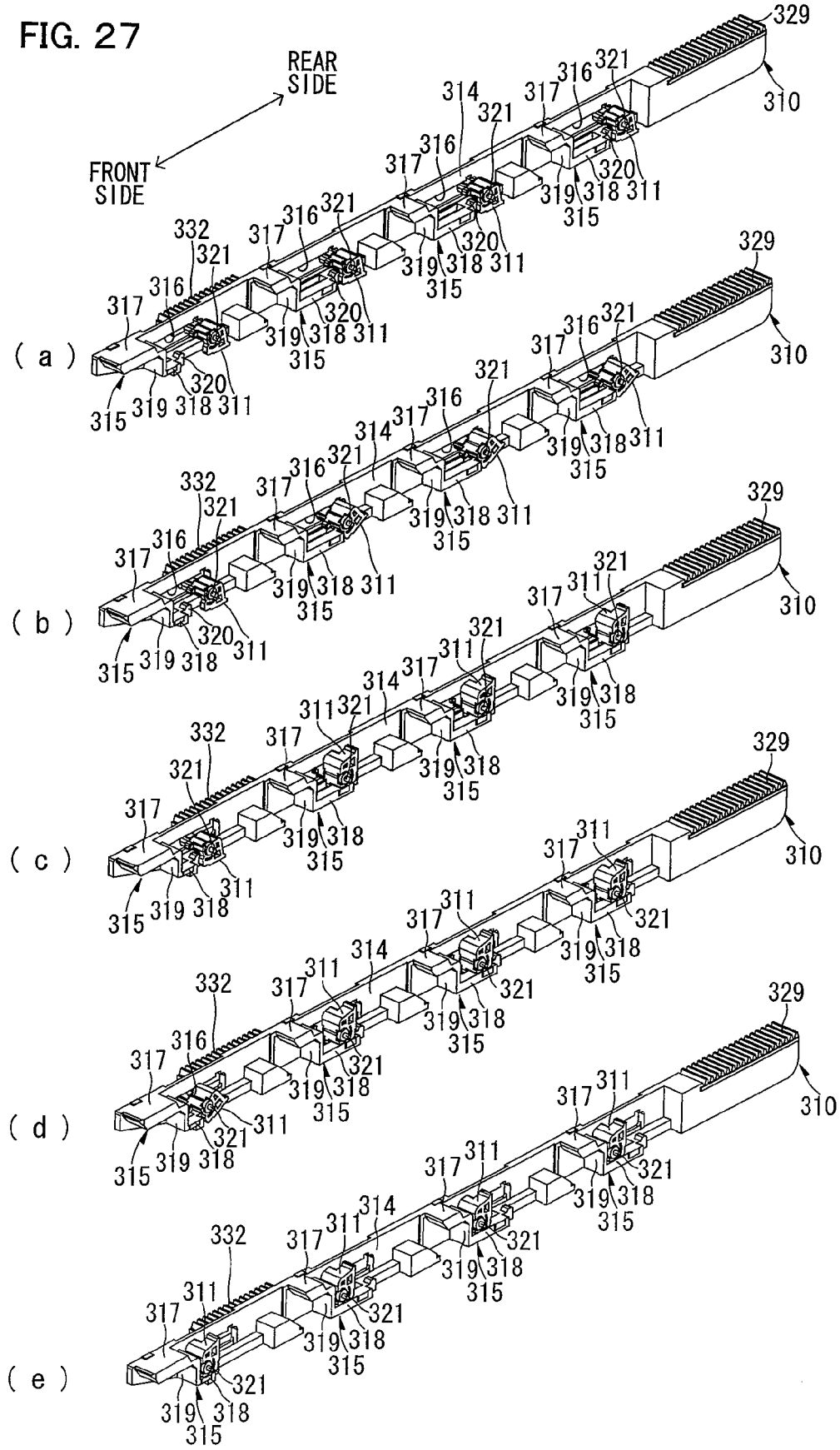
FIGS. 27(*a*) to 27(*e*) are perspective views for describing movements of the translation cam member and the intermediate member.
Figure 28:
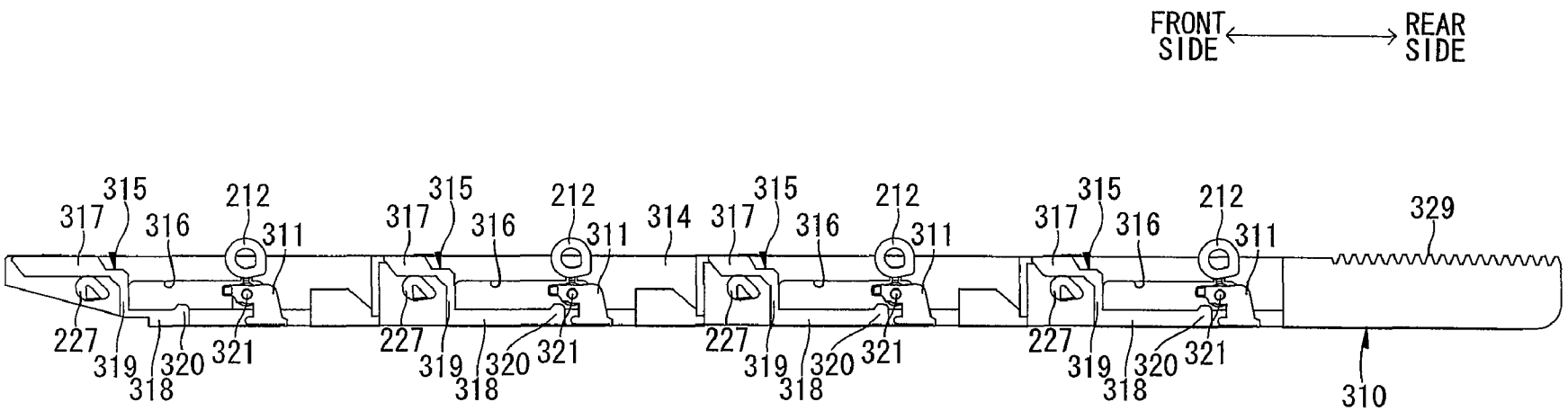
FIG. 28 is a right side view of the translation cam member and the intermediate member in the state of FIG. 27(*a*).
Figure 29:
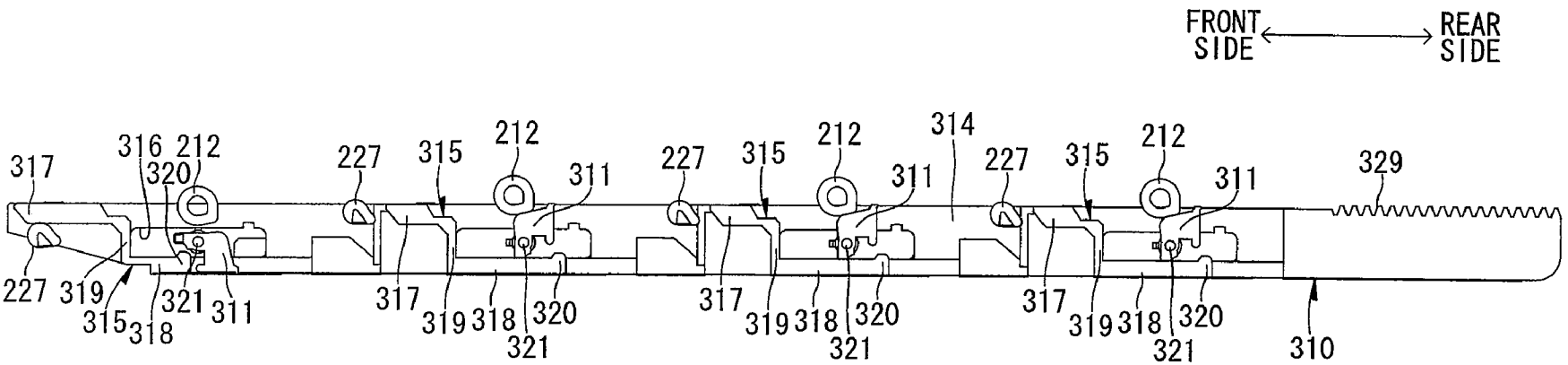
FIG. 29 is a right side view of the translation cam member and the intermediate member in the state of FIG. 27(*c*).
Figure 30:
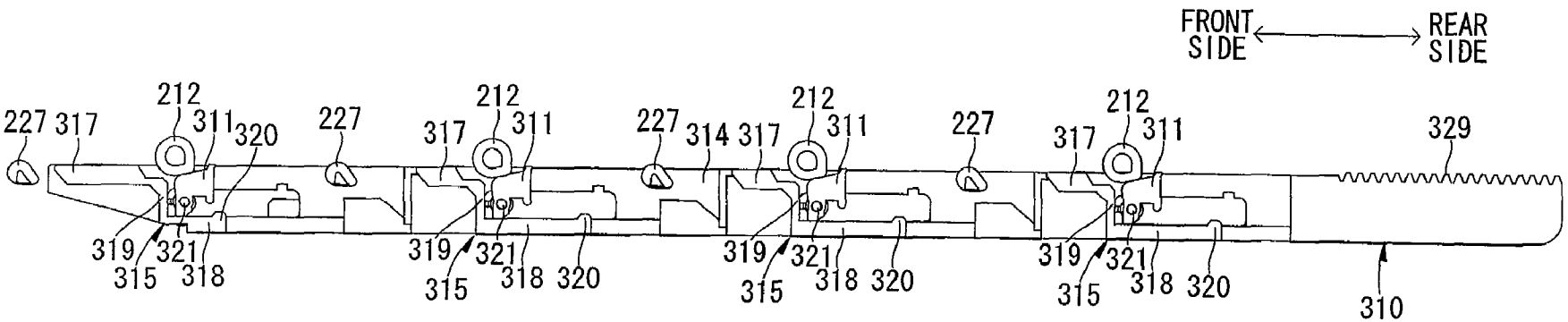
FIG. 30 is a right side view of the translation cam member and the intermediate member in the state of FIG. 27(*e*).

FIG. 26 is a perspective view of the translation cam members, the intermediate members, and the synchronized movement mechanism as viewed from the upper right front. Specifically, FIG. 26 is a perspective view of the spacing/pressuring mechanism as viewed from the upper right front which omits the cam holders. FIGS. 27(*a*) to 27(*e*) are perspective views for describing a movement of the translation cam member and the intermediate member. Further, FIG. 28 is a right side view of the translation cam member and the intermediate member in the state of FIG. 27(*a*). FIG. 29 is a right side view of the translation cam member and the intermediate member in the state of FIG. 27(*c*). FIG. 30 is a right side view of the translation cam member and the intermediate member in the state of FIG. 27(*e*).

The translation cam member 310 includes a cam main body plate 314 formed in a thin plate shape extending in the anteroposterior direction along the inner surface of the main body frame 301 (see FIG. 23), and four operation members 315 provided on the inner surface of the cam main body plate 314 in the width direction, as shown in FIG. 26.

The cam main body plate 314 includes four rectangular holes 316 which are long in the anteroposterior direction and formed in a generally rectangular shape, and spaced at the same intervals to one another in the anteroposterior direction.

The four operation members 315 are arranged respectively at the front sides of the four rectangular holes 316. Each operation member 315 is formed in a crank shape as viewed from the side and extends along the upper end edge of the cam main body plate 314. Each operation member 315 integrally includes a pressuring part 317 for pressing down the pressing projection 227 of the developer cartridge 27, a spacing part 318 extending along the lower end edge of the cam main body plate 314 for pivoting the intermediate member 311 as described later, and a connecting portion 319 which connects the rear end portion of the pressuring part 317 and the front end portion of the spacing part 318 with each other.

The rear end portion of the spacing part 318 is formed with a projection portion 320 which projects upward, as shown in FIGS. 28 to 30.

The forefront operation member 315 is different in shape from the other three operation members 315 (referred to hereafter as "three rear operation members 315"). That is, the pressuring part 317 of the forefront operation member 315 is formed longer in the anteroposterior direction compared with the pressuring portions 317 of the three rear operation members 315. Further, the spacing part 318 of the forefront operation member 315 is formed shorter in the anteroposterior direction compared with the spacing portions 318 of the three rear operation members 315. Such differences of the shapes (sizes) make it possible for the developing rollers 39 of all the developer cartridges 27 to press the photosensitive drums 29, for only the developing roller 39 of black developer cartridge 27K to press the photosensitive drum 29, or for the developing rollers 39 of all the developer cartridges 27 to be spaced apart from the photosensitive drums 29.

The four intermediate members 311 are disposed at the rear sides of the four operation members 315, respectively, and oppose to the four rectangular holes 316, respectively, in the width direction, as shown in FIG. 26. Each intermediate member 311 is formed in a block shape having a generally U-shape as viewed from the side and being thick in the width direction, as shown in FIG. 28. Each intermediate member 311 has one end portion which is penetrated by an intermediate member support shaft 321 in the width direction, and is rotatably supported by this intermediate member support shaft 321. Each intermediate member 311 has the lower end portion which is disposed in an opposed spaced relation to the projection portion 320 of the spacing part 318 in the anteroposterior direction in a state of not contacting the spacing part 318.

The intermediate member support shafts 321 are spaced at the same intervals (the interval equal to the interval between the spacing projections 212 in the state where the four developer cartridges 27 shown in FIG. 21 are attached in the respective drum units 26) to one another in the anteroposterior direction. Each intermediate member support shaft 321 is inserted through the rectangular hole 316 which is opposed to the intermediate member 311 supported by the intermediate member support shaft 321, and extends laterally outward of the cam main body plate 314, as shown in FIG. 25. The inner edge of the intermediate member support shaft 321 in the width direction is supported unrotatably by the cam holder 312.

The cam holder 312 integrally includes the holder fixing portion 322 formed in a thin plate shape and extending in the anteroposterior direction along the inner surface of the main body frame 301 (see FIG. 23), and the cam receiving portion 323 that is continuous with the lower end edge of this holder fixing portion 322 along the inner surface of the main body frame 301 (see FIG. 23).

The holder fixing portion 322 is fixed to the inner surface of the main body frame 301 (see FIG. 23) by a screw 324.

The cam receiving portion 323 is formed in a generally U-shape as viewed in section which extends laterally inward from the entire length of the lower end edge of the holder fixing portion 322, bends downward, and bends further laterally outward. The cam receiving portion 323 is formed with the four pressing projection receiving portions 325 that can receive the pressing projections 227 of the developer cartridge 27, and the four spacing projection receiving portions 326 that can receive the spacing projections 212 of the developer cartridge 27, which are disposed alternatively, by continuously notching the cam receiving portion 323 from the upper surface to the lateral inner surface thereof. That is, the cam receiving portion 323 is formed with the four pressing projection receiving portions 325 which are disposed in the anteroposterior direction in a spaced relation at the intervals equal to the interval between the pressing projections 227 in the state where each developer cartridge 27 is attached in the drum unit 26. The cam receiving portion 323 is also formed with the four spacing projection receiving portions 326 which are disposed in the anteroposterior direction in a spaced relation at the intervals equal to the interval between the spacing projections 212 in the state where each developer cartridge 27 is attached in the drum unit 26. Each spacing projection receiving portion 326 is disposed in back of the corresponding pressing projection receiving portion 325. Each spacing projection 212 is opposed to the corresponding intermediate member 311 from the upper side in the state where the spacing projection 212 is accepted by the corresponding spacing projection receiving portion 326, as shown in FIG. 28.

The synchronized movement mechanisms 313 is configured to transmit a driving force for the straight movement from the left translation cam member 310 to the right translation cam member 310 along with the straight movement of the left translation cam member 310, as shown in FIG. 25.

Specifically, the synchronized movement mechanisms 313 includes a left rack gear 327 formed on the upper surface of the rear end portion of the left translation cam member 310, a left pinion gear 328 meshed with the left rack gear 327, a right rack gear 329 formed on the upper surface of the rear end portion of the right translation cam member 310, a right pinion gear 330 meshed with the right rack gear 329, and a connecting shaft 331 to which the left pinion gear 328 and the right pinion gear 330 are mounted in a relatively unrotatable manner, as shown in FIG. 26.

Moreover, the left translation cam member 310 is provided with an input rack gear 332 which is applied with a driving force from a motor (not shown), on the lateral outward surface of the cam main body plate 314.

(4) Spacing/Pressuring Operation

The operation of the spacing/pressuring mechanism 303 will be described hereinafter, with referring to FIGS. 27(*a*) to 30.

The spacing part 318 of each operation member 315 and the intermediate member 311 disposed in back thereof are disposed in an opposed spaced non-contacting relation in the anteroposterior direction in the state where the translation cam member 310 is moved at the foremost position, as shown in FIGS. 27(*a*) and 28. An interval is formed between the spacing part 318 of the forefront operation member 315 and the intermediate member 311 disposed in back thereof. This interval is larger than the interval between each of the spacing portions 318 of the respective three rear operation members 315 and the corresponding intermediate member 311 disposed in back thereof.

In this state, the developing roller 39 is pressed against the photosensitive drum 29 in each developer cartridge 27. Specifically, the pressuring part 317 of each operation member 315 abuts against the pressing projection 227 of each developer cartridge 27 from the upper side and presses the pressing projection 227 downward. Since each pressing projection 227 is pressed downward, in each developer cartridge 27, the grip 103 pivots in the afore-mentioned pressing direction (see the solid arrow shown in FIG. 11) with the swinging shaft 114 as the supporting point to be located in the pressing state, as shown in FIG. 11, and the grip 103 (recess 225) presses down the abutting member 107 to compress the spring 102. The urging force of the spring 102 generated by this compression is inputted to the upper wall 84 of the developer frame 36, and the developer frame 36 is urged in the obliquely downwardly rearward direction (see the dotted arrow in the drawing, that is, the attaching direction of the developer cartridge 27 and the space releasing direction), whereby the developing roller 39 is pressed against the photosensitive drum 29. In this state, each fitting projection 104 of the grip 103 of the developer cartridge 27 is in the pressing position, as shown by the yellow developer cartridge 27Y in FIG. 21.

From this state, when the input rack gear 332 is input with a driving force from a motor (not shown) to move the left translation cam member 310 rearward, as shown in FIG. 26, the left pinion gear 328 rotates along with this movement of the left translation cam member 310. The rotation of this left pinion gear 328 is then transmitted to the right pinion gear 330 via the connecting shaft 331, and the right pinion gear 330 rotates in the direction identical with that of the left pinion gear 328, whereby the right translation cam member 310 is moved rearward.

With advancement of the rearward movement of the translation cam member 310, the engagement between the pressuring part 317 of each of the three rear operation members 315 shown in FIG. 28 and the pressing projection 227 of the developer cartridge 27 is released, and the pressing of the pressuring part 317 against the pressing projection 227 is released. Moreover, the spacing portions 318 of each of the three rear operation members 315 abuts against the lower end portion of the corresponding intermediate member 311 disposed in back thereof, presses the lower end portion of the intermediate member 311 rearward, and pivots the intermediate member 311 so that the intermediate member 311 is lifted with the intermediate member support shaft 321 as the supporting point, as shown in FIG. 27(*b*). In the midway of this pivoting of the intermediate member 311, the intermediate member 311 abuts against the spacing projection 212 located thereabove from the lower side, and a force is applied from the intermediate member 311 to the spacing projection 212 in the obliquely upwardly forward direction (that is, the detaching direction of the developer cartridge 27 and the spacing direction). Accordingly, the respective yellow developer cartridge 27Y, magenta developer cartridge 27M and cyan developer cartridge 27C corresponding to the spacing projections 212 are lifted in the spacing direction.

With further advancement of the rearward movement of the translation cam member 310, the yellow developer cartridge 27Y, the magenta developer cartridge 27M and the cyan developer cartridge 27C are lifted in the spacing direction until the one end portions (end portions through which the intermediate member support shafts 321 are inserted) of the respective intermediate members 311 abut against the upper surfaces of the spacing portions 318 of the three rear operation members 315, as shown in FIGS. 27(*c*) and 29. Then, the respective developing rollers 39 of the yellow developer cartridge 27Y, the magenta developer cartridge 27M and the cyan developer cartridge 27C are spaced apart from the corresponding photosensitive drums 29. On the other hand, the pressing projection 227 of the black developer cartridge 27K is pressed by the pressuring part 317 of the operation member 315. As a result, only the developing roller 39 of the black developer cartridge 27K is pressed against the photosensitive drum 29. In this state, the fitting projection 104 of the grip 103 in each of the yellow developer cartridge 27Y, the magenta developer cartridge 27M and the cyan developer cartridge 27C is in the spacing position as shown by the magenta developer cartridge 27M in FIG. 21. On the other hand, the fitting projection 104 of the black developer cartridge 27K remains in the pressing position as shown by the yellow developer cartridge 27Y in FIG. 21.

With further advancement of the rearward movement of the translation cam member 310, the engagement between the pressuring part 317 of the forefront operation member 315 and the pressing projection 227 of the black developer cartridge 27K is released, and the pressing of the pressuring part 317 against the pressing projection 227 is released. Moreover, as shown in FIG. 27(*d*), the spacing part 318 of the foremost operation member 315 abuts against the lower end portion of the intermediate member 311 disposed in back thereof, presses the lower end portion of the intermediate member 311 rearward, and pivots the intermediate member 311 so that the intermediate member 311 is lifted up with the intermediate member support shaft 321 as the supporting point. In the midway of this pivoting of the intermediate member 311, the intermediate member 311 abuts against the spacing projection 212 of the black developer cartridge 27K located thereabove from the lower side, and a force is applied in the spacing direction from the intermediate member 311 to the spacing projection 212, whereby the black developer cartridge 27K is lifted up in the spacing direction.

With further advancement of the rearward movement of the translation cam member 310, the black developer cartridge 27K is lifted up in the spacing direction until the one end portion (end portion through which the intermediate member support shaft 321 is inserted) of the intermediate member 311 abuts against the upper surface of the spacing part 318 of the foremost operation member 315, whereby the developing roller 39 of the black developer cartridge 27K is spaced apart from the photosensitive drum 29, as shown in FIGS. 27(*e*) and 30. As a result, the developing rollers 39 of all the developer cartridges 27 are in the spaced relation to the photosensitive drums 29, and the fitting projections 104 of the respective developer cartridges 27 are in the spacing position (see the magenta developer cartridge 27M in FIG. 21).

The state shown in FIG. 27(*e*) can be returned to each of the states shown in FIGS. 27(*a*) to 27(*d*) by moving forward the translation cam member 310. At this time, the projection portion 320 of the spacing part 318 engages with the intermediate member 311 and pivots the intermediate member 311 toward the direction (downward) toward which the intermediate member 311 is spaced apart from the spacing projection 212.

6. Operations and Effects

As described above, in this color laser printer 1, since the developer cartridge 27 is attached to the drum unit 26 and the fitting projection 104 equipped in the grip 103 of the developer cartridge 27 is fitted to the side frame 134 of the drum unit 26, the developer cartridge 27 can be reliably locked to the drum unit 26.

Moreover, in the locked state, the fitting projection 104 is fitted loosely in the fitting hole 140 of the side frame 134 so that the fitting projection 104 can move along the pivoting direction (the pressing direction and the pressure releasing direction) of the grip 103. Specifically, in the state where the fitting projection 104 is fitted loosely in the fitting hole 140, the first gap C is formed between the fitting projections 104 located at the releasing position and the end portion of the fitting hole 140 on the downstream side in the pressing direction. As a result, the fitting projection 104 which is loosely fit in the fitting hole 140 and located at the releasing position, can reliably move (pivot) to the pressing position, and corresponding to this movement of the fitting projection 104, the grip 103 can also move (pivot) in this moving direction. Therefore, when a pressing force is applied from the spacing/pressuring mechanism 303 to the pressing projection 227 in the state where the fitting projection 104 is loosely fitted in the fitting hole 140, the grip 103 pivots along the pressing direction and the developing roller 39 can be reliably pressed against the photosensitive drum 29.

As a result, with a simple structure, the pressing operation of the developing roller 39 against the photosensitive drum 29 can be achieved while the developer cartridge 27 can be reliably locked.

In addition, in the locked state, the fitting projection 104 is fitted loosely in the fitting hole 140 so that the fitting projection 104 can move along the intersecting direction (the spacing direction and the space releasing direction) which intersects the pivoting direction of the grip 103. Specifically, in the state where the fitting projection 104 is fitted loosely in the fitting hole 140, the second gap D is formed between the fitting projections 104 located at the releasing position and the end portion of the fitting hole 140 on the downstream side in the spacing direction. As a result, when the fitting projection 104 is loosely fitted in the fitting hole 140 and located at the releasing position, the fitting projection 104 can reliably move to the spacing position. Corresponding to this movement of the fitting projection 104, the spacing projection 212 can also move along the spacing direction. Therefore, when a pressing force is applied from the spacing/pressuring mechanism 303 to the spacing projection 212 in the state where the fitting projection 104 is loosely fitted in the fitting hole 140, the spacing projection 212 moves along the spacing direction, whereby the developing roller 39 can be reliably spaced away from the photosensitive drum 29. Accordingly, the spacing operation together with the pressing operation can be achieved, thereby improving the functionality.

The fitting projection 104 at the pressing position and the fitting projection 104 at the spacing position move to the identical releasing position when the pressing of the spacing/pressuring mechanism 303 against the pressing projection 227 and the spacing projection 212 are released respectively. Specifically, since the position (pressure releasing position) of the fitting projection 104 when the pressing of the spacing/pressuring mechanism 303 against the pressing projection 227 is released, and the position (space releasing position) of the fitting projection 104 when the pressing of the spacing/pressuring mechanism 303 against the spacing projection 212 is released are identical to each other, the position of the developer cartridge 27 can be kept constant when the pressing force is not applied to the pressing projection 227 and the spacing projection 212.

Moreover, the fitting projection 104 has the front end portion formed with the front-side inclined surface 117 and the rear end portion formed with the rear-side inclined surface 118. Accordingly, the smooth movement of the fitting projection 104 with respect to the projection guide groove 139 can be ensured when the fitting projection 104 is fitted loosely into the fitting hole 140 and released from the fitting hole 140, more specifically, when the fitting projection 104 goes into and goes out from the projection guide groove 139, thereby improving the operability.

When attempting to detach the developer cartridge 27 from the drum subunit 28 in the obliquely upwardly forward direction (the detaching direction of the developer cartridge 27 and the spacing direction) in the state where the fitting projection 104 is loosely fitted in the corresponding fitting hole 140, the fitting projection 104 moves to the restricting position. When the fitting projection 104 moves to the restricting position, the upper front end face 141 and the upper rear end face 142 of the fitting hole 140, and the corresponding front end face 119 and rear end face 120 of the fitting projection 104 respectively abut against each other in the direction orthogonal to the opposed direction thereof. Therefore, such abutment can prevent the detaching of the developer cartridge 27 from the drum subunit 28 while the fitting projection 104 remains in the fitting hole 140. Accordingly, operational errors can be prevented, and the durability of the apparatus can be improved. Further, as described above, the lengths of the upper front end face 141 (excluding the front end portion) and the upper rear end face 142 in the width direction are formed so as to be equal to the length (thickness of the protruding portion 151) in the width direction. Accordingly, the abutting area of the upper front end face 141 and the upper rear end face 142 against the front end face 119 and rear end face 120 can be increased, whereby the above described detaching can reliably be prevented.

In the drum subunit 28, since the passing portion 143 is formed with the projection guide groove 139, a smooth and reliable movement of the fitting projection 104 can be secured and the operability can be improved.

In addition, the projection guide groove 139 is formed with the upper inclined surface 146 on the upper end portion thereof, and also formed with the lower inclined surface 147 on the lower end portion thereof. Therefore, a smooth movement of the fitting projection 104 with respect to the projection guide groove 139 can be secured when the fitting projection 104 is fitted loosely into and released from the fitting hole 140, more specifically, when the fitting projection 104 goes into and goes out from the projection guide groove 139. Accordingly, together with the above-described front-side inclined surface 117 and the rear-side inclined surface 118 of the fitting projection 104, this can further improve the operability. As described above, the length (thickness) of the front portion 138 in the width direction in the projection guide groove 139 is shorter than the lengths of the upper front end face 141 (excepting the front end portion) and the upper rear end face 142 in the width direction, that is, shorter than the length (thickness) of the protruding portion 151 in the width direction. Since the lengths of the upper front end face 141 (excepting the front end portion) and the upper rear end face 142 in the width direction are formed to be equal to the length (thickness) of the protruding portion 151 in the width direction, the above-described detaching of the developer cartridge 27 can be reliably prevented and a smooth movement of the fitting projection 104 can be secured in the projection guide groove 139 whose length in the width direction is smaller than the protruding portion 151.

In the color laser printer 1, a plurality of the photosensitive drums 29, a plurality of the drum subunits 28 respectively including the side frames 134, and a plurality of the developer cartridges 27 are, as the drum unit 26 together attached to and detached from the main body casing 2 in a slidable manner, thereby improving the operability and achieving image formation with a plurality of colors.

When the drum unit 26 is attached in the main body casing 2, each grips 103 in the standing state before attaching the drum unit 26 to the main body casing 2 are abutted by the front end portion of the scanner casing 24 of the scanning section 20 in the midway of the attaching, and pivot sequentially to the inclined state. When the drum unit 26 is completely attached in the main body casing 2, each grip 103 pivots to the inclined state and the fitting projection 104 thereof is fitted loosely into the fitting hole 140. Therefore, the grip 103 needs not to be previously pivoted by hand so that the fitting projection 104 is fitted loosely into the fitting hole 140 before attaching the drum unit 26 to the main body casing 2, thereby improving the operability.

As described above, the front end portion of the scanner casing 24 forms the lower half portion of the front end face of the scanning section 20, and the front end face of the scanning section 20 forms the main body front wall 300 that is the front-side wall of the main body casing 2. Specifically, since the front end portion of the scanner casing 24 is disposed on the outside surface of the main body front wall 300, it is not necessary to secure a space to dispose a component which has the function similar to the front end portion of the scanner casing 24 (abutting against the grip 103 to pivot the grip 103 to the inclined position and fit the fitting projection 104 loosely into the fitting hole 140) in the main body casing 2, thereby downsizing the apparatus. When the drum unit 26 is attached to the main body casing 2, all the grips 103 abut against the front end portion of the scanner casing 24 and all the fitting projections 104 are fitted loosely into the corresponding fitting holes 140, thereby securing more reliable operation.

Second Embodiment

Although in the above description a tandem type color laser printer has been illustrated as an example of an image forming apparatus, an image forming apparatus equipped with the drum unit and the developer cartridge of one or more aspects of the present invention is not limited to the above description, and one or more aspects of the present invention may include an intermediate transfer type color laser printer which temporarily transfers toner images of respective colors from photosensitive members to an intermediate transfer body and then transfers the images onto the sheet 3 at a time, and a monochrome laser printer.

The embodiments described above are illustrative and explanatory of the invention. The foregoing disclosure is not intended to be precisely followed to limit the present invention. Various modifications and alterations are possible in light of the foregoing description, and may be obtained by implementing the invention. The present embodiments are selected and described for explaining the essence and practical applicational schemes of the present invention which allow those skilled in the art to utilize the present invention in various embodiments and various alterations suitable for anticipated specific use. The scope of the present invention is to be defined by the appended claims and their equivalents.

What is claimed is:

1. A photosensitive unit comprising:

a developer cartridge comprising a developing agent carrier that carries a developing agent and a casing that supports the developing agent carrier and accommodates the developing agent;

a photosensitive member disposed so that the developing agent carrier is press-contacted to the photosensitive member, and in which an electrostatic latent image is developed by the developing agent supplied from the developing agent carrier; and a side wall to which the developer cartridge is detachably attached, wherein the casing is provided with a pivoting member, the pivoting member comprising a pressuring portion applied with an external pressing force and a fitting projection fitted to the side wall, and the pivoting member is configured to be pivoted along a pressing direction for pressing the developing agent carrier toward the photosensitive member when a pressing force is applied to the pressuring portion, or along a pressure releasing direction opposite to the pressing direction, and the side wall is formed with a fit portion in which the fitting projection is loosely received so that a movement of the fitting projection along a pivoting direction of the pivoting member is allowed.

2. The photosensitive unit according to claim 1, wherein the fitting projection is configured to move between a pressing position at which the pressing force is applied to the pressuring portion, and a pressure releasing position at which the pressing force is released, while the fitting projection is loosely received in the fit portion, and a first gap is formed between the fitting projection that is located at the pressure releasing position and a downstream end portion of the fit portion in the pressing direction.

3. The photosensitive unit according to claim 1, wherein the casing is provided with a spacing portion for spacing the developing agent carrier apart from the photosensitive member in a spacing direction which intersects the pivoting direction when an external pressing force is applied, and the fitting projection is loosely received in the fit portion so that a movement of the fitting projection is allowed along the spacing direction or an intersecting direction which is a space releasing direction opposite to the spacing direction.

4. The photosensitive unit according to claim 3, wherein the fitting projection is configured to move between a spacing position at which a pressing force is applied to the spacing portion, and a space releasing position at which the pressing force is released, while the fitting projection is loosely received in the fit portion, and a second gap is formed between the fitting projection that is located at the space releasing position and a downstream end portion of the fit portion in the spacing direction.

5. The photosensitive unit according to claim 4, wherein the pressure releasing position is identical with the space releasing position.

6. The photosensitive unit according to claim 1, wherein the fitting projection is formed with an inclined surface which inclines with respect to a first plane including the pivoting direction and a second plane orthogonal to the first plane, on at least either one of end portions in the pivoting direction.

7. The photosensitive unit according to claim 6, wherein the fitting projection is formed with the inclined surface on each of both end portions thereof in the pivoting direction.

8. The photosensitive unit according to claim 1, wherein the developer cartridge is configured to be detached and attached with respect to the side wall in a direction intersecting the pivoting direction, and opposed surfaces of respective end portions of the fitting projection and the fit portion opposed with each other, is orthogonal to an opposed direction thereof, in a detaching direction for detaching the developer cartridge with respect to the side wall.

9. The photosensitive unit according to claim 1, wherein the side wall is formed with a guide groove along the pivoting direction for guiding the passage of the fitting projection.

10. The photosensitive unit according to claim 9, wherein the guide groove is formed with an inclined surface which inclines with respect to a first plane including the pivoting direction and a second plane orthogonal to the first plane, on at least either one of end portions in the pivoting direction.

11. The photosensitive unit according to claim 10, wherein the guide groove is formed with the inclined surface on both end portions thereof in the pivoting direction.

12. The photosensitive unit according to claim 1, wherein a plurality of the photosensitive members, a plurality of the side walls, and a plurality of the developer cartridges are together configured to be attached to and detached from an image forming apparatus body in a slidable manner.

13. The photosensitive unit according to claim 1, wherein the fitting portion is configured to move inwardly and laterally outwardly.

14. The photosensitive unit according to claim 1, wherein the fitting projection is loosely received in the fit portion when the pivoting member is pivoted in the pressing direction and released from the fit portion when the pivoting member is pivoted in the pressure releasing direction.

15. An image forming apparatus comprising a photosensitive unit, and an image forming apparatus body which the photosensitive unit is configured to be detached from and attached to in a slidable manner, wherein the photosensitive unit comprises:

a plurality of developer cartridges comprising a developing agent carrier that carries a developing agent and a casing that supports the developing agent carrier and accommodates the developing agent;

a plurality of photosensitive members disposed so that the developing agent carrier is press-contacted to the photosensitive member, and in which an electrostatic latent image is developed by the developing agent supplied from the developing agent carrier; and a plurality of side walls to which the developer cartridge is detachably attached, wherein the respective casing is provided with a pivoting member, the pivoting member comprising a pressuring portion applied with an external pressing force and a fitting projection fitted to the side wall, and the pivoting member is configured to be pivoted along a pressing direction for pressing the developing agent carrier toward the photosensitive member when a pressing force is applied to the pressuring portion, or along a pressure releasing direction opposite to the pressing direction, and the respective side wall is formed with a fit portion in which the fitting projection is loosely received so that a movement of the fitting projection along a pivoting direction of the pivoting member is allowed, and the image forming apparatus body comprises a pressing force generating unit applying a pressing force to the pressuring portion.

16. The image forming apparatus according to claim 15, wherein the image forming apparatus body comprises an intervening portion which contacts the pivoting member and pivots the pivoting member so that the fitting projection is loosely received in the fit portion when the photosensitive unit is attached to the image forming apparatus body.

17. The image forming apparatus according to claim 16, wherein the image forming apparatus body comprises a main body wall on the upstream end portion thereof in a direction for attaching the photosensitive unit to the image forming apparatus body, and the intervening portion is disposed on an outside surface of the main body wall.

18. The image forming apparatus according to claim 15, wherein the fitting projection is configured to move between a pressing position at which the pressing force is applied to the pressuring portion, and a pressure releasing position at which the pressing force is released, while the fitting projection is loosely received in the fit portion, and a first gap is formed between the fitting projection that is located at the pressure releasing position and a downstream end portion of the fit portion in the pressing direction.

19. The image forming apparatus according to claim 15, wherein the casing is provided with a spacing portion for spacing the developing agent carrier apart from the photosensitive member in a spacing direction which intersects the pivoting direction when an external pressing force is applied, the pressing force generating unit is configured to apply a pressing force to the spacing portion, and the fitting projection is loosely received in the fit portion so that a movement of the fitting projection is allowed along the spacing direction or an intersecting direction which is a space releasing direction opposite to the spacing direction.

20. The image forming apparatus according to claim 19, wherein the fitting projection is configured to move between a spacing position at which a pressing force is applied to the spacing portion, and a space releasing position at which the pressing force is released, while the fitting projection is loosely received in the fit portion, and a second gap is formed between the fitting projection that is located at the space releasing position and a downstream end portion of the fit portion in the spacing direction.

21. The image forming apparatus according to claim 20, wherein the pressure releasing position is identical with the space releasing position.

22. The image forming apparatus according to claim 15, wherein the fitting projection is formed with an inclined surface which inclines with respect to a first plane including the pivoting direction and a second plane orthogonal to the first plane, on at least either one of end portions in the pivoting direction.

23. The image forming apparatus according to claim 15, wherein the developer cartridge is configured to be detached and attached with respect to the side wall in a direction intersecting the pivoting direction, and opposed surfaces of respective end portions of the fitting projection and the fit portion opposed with each other, is orthogonal to an opposed direction thereof, in a detaching direction for detaching the developer cartridge with respect to the side wall.

24. The image forming apparatus according to claim 15, wherein the side wall is formed with a guide groove along the pivoting direction for guiding the passage of the fitting projection.

25. The image forming apparatus according to claim 24, wherein the guide groove is formed with an inclined surface which inclines with respect to a first plane including the pivoting direction and a second plane orthogonal to the first plane, on at least either one of end portions in the pivoting direction.

26. The image forming apparatus according to claim 15, wherein the fitting portion is configured to move inwardly and laterally outwardly.

27. The image forming apparatus according to claim 15, wherein the fitting projection is loosely received in the fit portion when the pivoting member is pivoted in the pressing direction and released from the fit portion when the pivoting member is pivoted in the pressure releasing direction.

* * * * *